US010166483B2

(12) United States Patent
Brassard

(10) Patent No.: US 10,166,483 B2
(45) Date of Patent: Jan. 1, 2019

(54) TRAPDOOR DROP AMUSEMENT MECHANISM

(75) Inventor: Daniel Pierre Brassard, Burnaby (CA)

(73) Assignee: WHITEWATER WEST INDUSTRIES LTD., Richmond, BC (CA)

( * ) Notice: Subject to any disclaimer, the term of this patent is extended or adjusted under 35 U.S.C. 154(b) by 0 days.

(21) Appl. No.: 14/381,938

(22) PCT Filed: Feb. 29, 2012

(86) PCT No.: PCT/US2012/027132

§ 371 (c)(1),
(2), (4) Date: Aug. 28, 2014

(87) PCT Pub. No.: WO2013/130072

PCT Pub. Date: Sep. 6, 2013

(65) Prior Publication Data

US 2015/0045129 A1 Feb. 12, 2015

(51) Int. Cl.
*A63G 21/18* (2006.01)
*A63G 21/10* (2006.01)

(52) U.S. Cl.
CPC ..... *A63G 21/18* (2013.01); *A63G 21/10* (2013.01)

(58) Field of Classification Search
CPC ..... A63G 21/18
See application file for complete search history.

(56) References Cited

U.S. PATENT DOCUMENTS 2,705,144 A * 3/1955 Ridgway ..... A63G 31/00 193/2 R
4,278,247 A 7/1981 Joppe et al.
4,373,289 A * 2/1983 Douglas ..... A63H 33/00 292/200
4,484,739 A 11/1984 Kreinbihl et al.
5,183,437 A * 2/1993 Millay ..... A63G 21/18 472/116

OTHER PUBLICATIONS

International Search Report for Application No. PCT/US2012/027132, dated Sep. 3, 2012, 3 pgs.

* cited by examiner

*Primary Examiner* — Michael Dennis
(74) *Attorney, Agent, or Firm* — Erikson C. Squier; Buchalter LLP

(57) ABSTRACT

A trapdoor mechanism and method of providing a trapdoor mechanism for initiating descent into a slide ride is disclosed. Aspects of invention are directed to an energy efficient mechanism capable of dropping slide riders into the entrance of a slide ride. The trapdoor mechanism utilizes momentum produced by the force of gravity to swing the trapdoor to an open position, to a closed position, and back to the open position. A control device may be utilized to apply force to the trapdoor during its transit between the open position and closed position.

13 Claims, 19 Drawing Sheets

TRAPDOOR DROP AMUSEMENT MECHANISM

FIELD

The present invention relates to an apparatus and method for providing a trapdoor drop amusement mechanism.

BACKGROUND

The popularity of family-oriented theme parks and recreational facilities has increased dramatically in the last decade. In particular, water parks have proliferated as adults and children, alike, seek the thrill and entertainment of water parks as a healthy and enjoyable way to cool off in the hot summer months.

Most theme parks consist primarily of ride attractions. Some of the more popular among these are slides in which participants slide down a trough or tunnel. In waterpark, the rider may slide upon water on the slide, and splash down into a pool of water. As demand for such attractions has increased, parks have continued to evolve ever larger and more complex slides to thrill and entertain growing numbers of water play participants.

Many slide rides attract customers by offering high speed travel through the slide. To achieve such high speeds, slides may include a trapdoor system that quickly drops a rider from a rest position to a near vertical descent into the slide ride. Such trapdoor systems are traditionally actuated by a series of springs or pistons that forcefully and quickly move the trapdoor between a closed position and an open position. Such devices require large amounts of energy to operate. In addition, such devices may be dangerous if a rider becomes stuck by the trapdoor and pinned by the force of a spring or piston.

SUMMARY

Aspects of the present invention relate to an apparatus and method for providing a trapdoor drop amusement mechanism. Embodiments of the trapdoor drop amusement mechanism are directed to providing an energy efficient method to quickly drop a rider into a slide, or waterslide ride. Embodiments of the trapdoor drop amusement mechanism utilize momentum produced by the force of gravity to move a trapdoor between a closed position and an open position. The use of gravity reduces the energy required to operate the trapdoor, for example the energy expended to operate the motors, pistons, or gears of the prior art. Embodiments of the trapdoor drop amusement mechanism may utilize a control device to exert a minimal force against the trapdoor, to compensate for frictional losses during operation.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
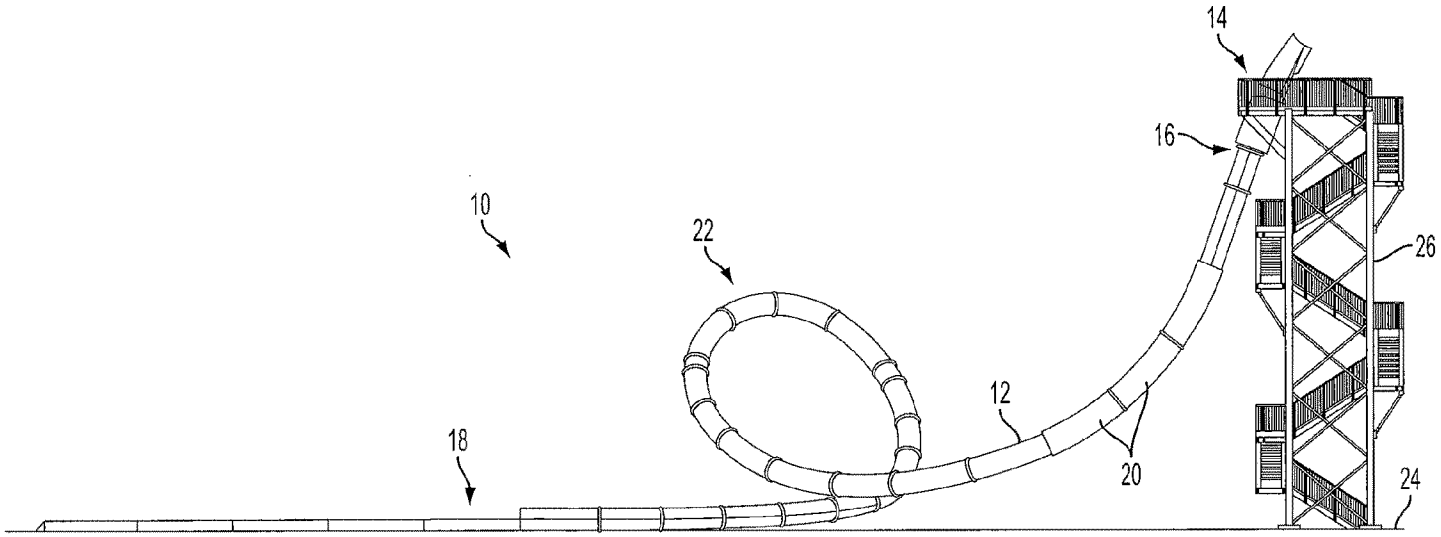
FIG. 1 is a side view of a slide ride according to an embodiment of the present invention.

FIG. 1 illustrates one embodiment of the present invention, displaying a slide ride 10 including a flume 12 and a trapdoor mechanism 14. In one embodiment, the slide ride 10 may comprise a waterslide, for a rider to slide upon, on a layer of water. In one embodiment, the slide ride 10 may comprise a dry slide ride, or a slide the rider slides upon without water. In certain embodiments, the rider may slide upon the dry slide ride, or the waterslide on a vehicle which may have wheels, runners, or rails, or the like for the rider to slide upon. The flume 12 comprises a structure a rider may slide upon, to travel from an entrance 16 to an exit 18 of the flume 12. The flume 12 may comprise a fully enclosed (as shown in FIG. 1), or partially enclosed structure, such as a half pipe or half shell. As shown in FIG. 1, the flume may be formed from a plurality of flume, or slide segments 20. In an embodiment in which the ride comprises a waterslide, the slide segments 20 may comprise waterslide segments 20. A plurality of the flume segments, or slide segments 20 are joined end to end, forming a channel, or path, for the rider to follow, when traveling from the entrance 16 to the exit 18. The individual flume segments, or slide segments 20 may be shaped differently, or similarly, depending on the desired path for the rider to follow. For example, in the embodiment shown in FIG. 1, the slide segments 20 are shaped to create a loop 22 for the rider to travel through.

In a waterslide embodiment, the rider may slide upon a surface of the flume 12 upon a layer of water. The water reduces friction between the rider and the surface of the flume 12, allowing the rider to achieve great speeds as he or she traverses from the entrance 16 to the exit 18.

In the embodiment shown in FIG. 1, the entrance 16 of the flume 12 is elevated above ground level 24. The entrance 16 is elevated such that a rider experiences a force of gravity that draws from the entrance 16 to the exit 18. Accordingly, in the embodiment shown in FIG. 1, the entrance 16 is positioned atop a tower 26 a rider will climb to reach the entrance 16 of the flume 12. During the rider's ascent of the tower 26, the rider gains gravitational potential energy. This gravitational potential energy allows the rider to later travel through the flume 12, and pass through the loop 22 rapidly, eventually sliding into the exit 18 of the flume 12. The speed and centripetal forces experienced by the rider enhance his or her overall enjoyment.

It may be desirable to cause the rider to quickly drop, or descend into the entrance 16 of the flume 12, to enhance the speed experienced by the rider as he or she travels from the entrance 16 to the exit 18. At least in part to enhance the sensation of speed for a rider, the trapdoor mechanism 14 is positioned at the entrance 16 of the flume 12. The trapdoor mechanism 14 comprises a control system for controlling entry of the rider into the entrance 16 of the flume 12. The trapdoor mechanism 14 is capable of moving between two states: the first being a state in which a rider does not enter the entrance 16 of the flume 12; and the second being a state in which the rider does enter the entrance 16 of the flume 12. The trapdoor mechanism 14 may be configured to allow the rider to rapidly descend into the entrance 16, for example, to allow the rider to maintain enough speed to pass through the loop 22 of the flume 20.

Figure 2:
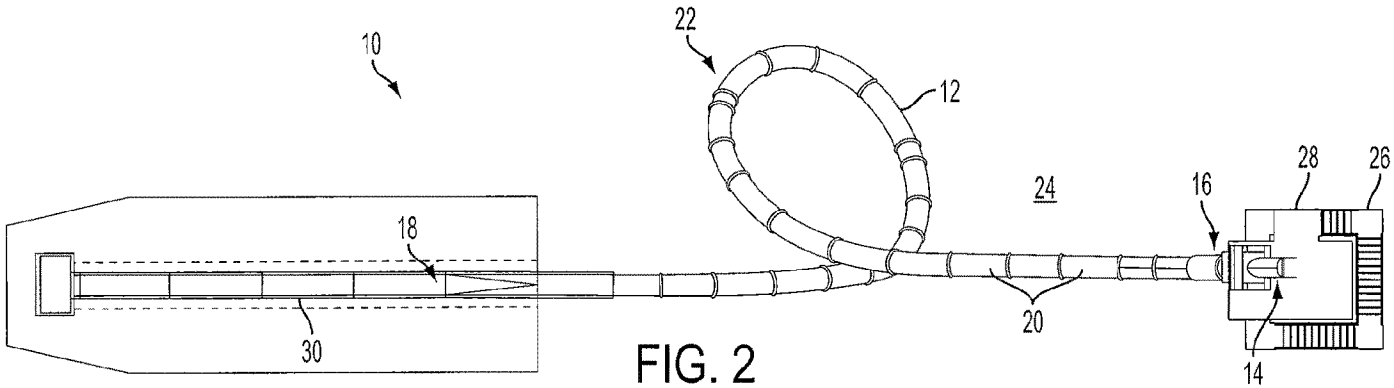
FIG. 2 is a top view of the slide ride of FIG. 1 according to an embodiment of the present invention.

FIG. 2 illustrates a top view of the slide ride 10 embodiment shown in FIG. 1. FIG. 2 illustrates the tower 26 includes a stage 28 a rider stands upon before using the trapdoor mechanism 14. The tower 26 may include a queue for receiving a line of riders before each utilizes the trapdoor mechanism 14. FIG. 2 also illustrates the exit 18 of the flume 12 includes a run out zone 30, which may include sufficient friction surfaces in a dry ride embodiment, or water in a waterslide embodiment, to rapidly slow the rider's descent from the flume 12. After passing through the run out zone 30, the rider may stand up, exit the ride 10, and return to the tower 26 for another ride through the flume 12.

In the embodiment shown in FIGS. 1 and 2, the rider may slide upon the surface of the flume 12 without a raft device, or with a raft device, as desired.

Figure 3:
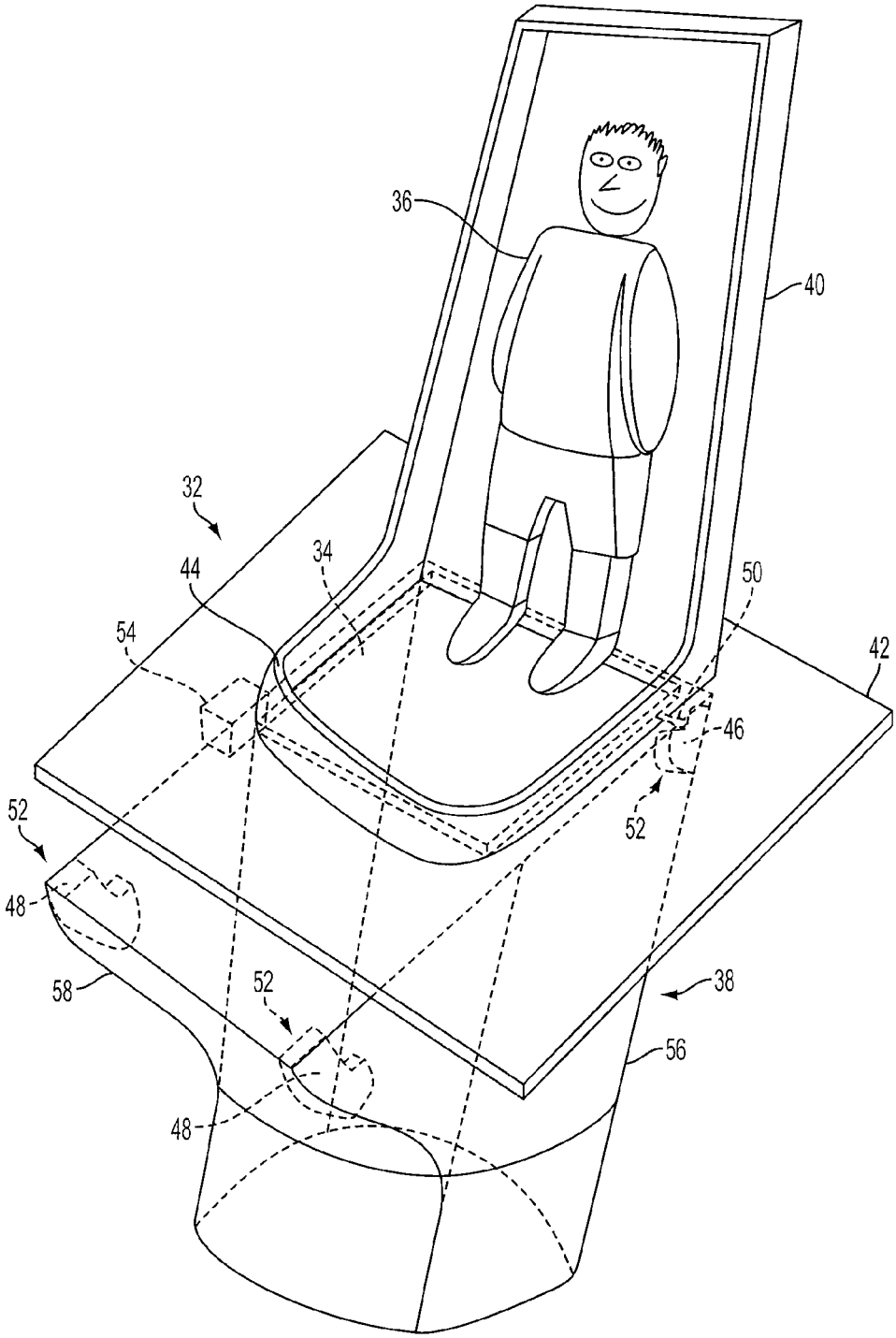
FIG. 3 is a perspective view of a trapdoor mechanism according to an embodiment of the present invention.

FIG. 3 illustrates a perspective schematic view of a trapdoor mechanism 32 for use in a slide ride, for example, the slide ride 10 shown in FIGS. 1 and 2. The trapdoor mechanism 32 may be used as the trapdoor mechanism 14 shown in FIGS. 1 and 2. FIG. 3 is a representation of the trapdoor mechanism 32, and may not necessarily illustrate every feature of the trapdoor mechanism 32, some of which may be illustrated or described in relation to other figures found in this application. FIG. 3 illustrates the trapdoor mechanism 32 includes a trapdoor, or gate, or platform 34 that a rider 36 stands upon before descending into the entrance 38 of a slide ride. The platform 34 is movable, such that in the configuration shown in FIG. 3, the rider may be positioned upon the platform 34, and does not descend into the entrance 38. In another configuration, for example, the configuration shown in FIGS. 6 and 7, the platform 34 is moved such that a rider cannot be positioned on the platform 34 and the rider descends into the entrance 38 after having been on the platform 34.

The platform 34 may comprise a flattened rigid surface, suitable for a rider to be positioned upon in any manner. In other embodiments, the platform 34 may have a partially or entirely curved shape, so long as a rider may still be positioned upon the platform 34. The platform 34 may be configured such that a rider may sit, squat, kneel, lay, stand or otherwise be positioned on the platform 34.

The trapdoor mechanism 32 shown in FIG. 1 additionally includes a support rest 40 aligned nearly vertically with a stage 42. A retainer 44 extends from the support rest 40. The support rest 40 may be positioned off vertical by approximately twenty degrees, as shown in FIG. 1. In other embodiments, the support rest 40 may be at any angle, between vertical or nearly at horizontal, as desired. The support rest 40 may provide a support for the rider 36 to rest against before descending into the entrance 38 of the slide ride.

The stage 42 comprises a surface for the rider 36 to travel upon, prior to utilizing the trapdoor mechanism 32. The stage 42 may comprise a rigid structure, forming part of a tower, for example, similar to the stage 28 shown in FIG. 2.

The retainer 44 comprises a raised surface for retaining water that may be pumped onto, or from the support rest 40 in a waterslide embodiment. In addition, the retainer 44 defines a boundary indicating where the platform 34 is positioned relative to the stage 42. In other embodiments, a shell, or enclosure may be incorporated, to enclose the rider 36 within the boundary of the retainer 44 and the support rest 40.

The trapdoor mechanism 32 may additionally include a plurality of supports 46, 48. The supports 46, 48 are utilized in combination with a lock 50, to form securing devices 52. The supports 46, 48 include closed position supports 46 and open position supports 48. The supports 46, 48 are shown in dashed lines in FIG. 3, and are more clearly visible in FIGS. 5, 7 and 8A-8J, for example. The supports 46, 48 are configured to retain, or hold, the platform 34 in a desired position. The closed position supports 46, for example, are configured to hold the platform 34 in a closed position, such that the rider 36 may be positioned upon the platform 34. The open position supports 48, for example, are configured to hold the platform 34 in an open position (shown in FIG. 6), such that the rider 36 may descend into the slide ride.

The lock 50 is configured to engage the supports 46, 48 to secure the platform 34 in a desired position. The lock 50 is shown in dashed lines in FIG. 3, and is more clearly visible in FIGS. 5, 7 and 8A-8J, for example. In certain embodiments, the lock 50 may be configured to automatically engage the supports 46, 48 as a result of the platform 34 reaching a desired orientation, without any control input or actuation.

The trapdoor mechanism 32 may additionally include a control device 54 configured to operate the securing devices 50. The control device 54 is shown in dashed lines in FIG. 3, and is more clearly visible in FIG. 15, for example. In the embodiment shown in FIG. 1, the control device 54 is configured to operate the lock 50 of the securing devices 52. In certain embodiments, the control device 54 may include a force generator capable of applying a force to the platform 34, to assist or cause the platform to move to various positions as desired.

The trapdoor mechanism 32 may additionally include a flume segment, or slide segment 56. The slide segment 56 may comprise an entrance 38 of the slide ride. The slide segment 56 may be configured to include a recess 58 for receiving the platform 34 in an open position. The slide segment 56 forming this portion of the trapdoor mechanism 32 may comprise a segment that the rider 36 slides upon, or merely drops through before entering other slide segments, or flume segments of the slide ride. In a waterslide embodiment, the slide segment 56 may be configured such that the rider 36 is capable of sliding on the slide segment upon water. The slide segment 56 may comprise a unitary structure, or may include a distinct housing configured to contain or receive components of the trapdoor mechanism.

Figure 4:
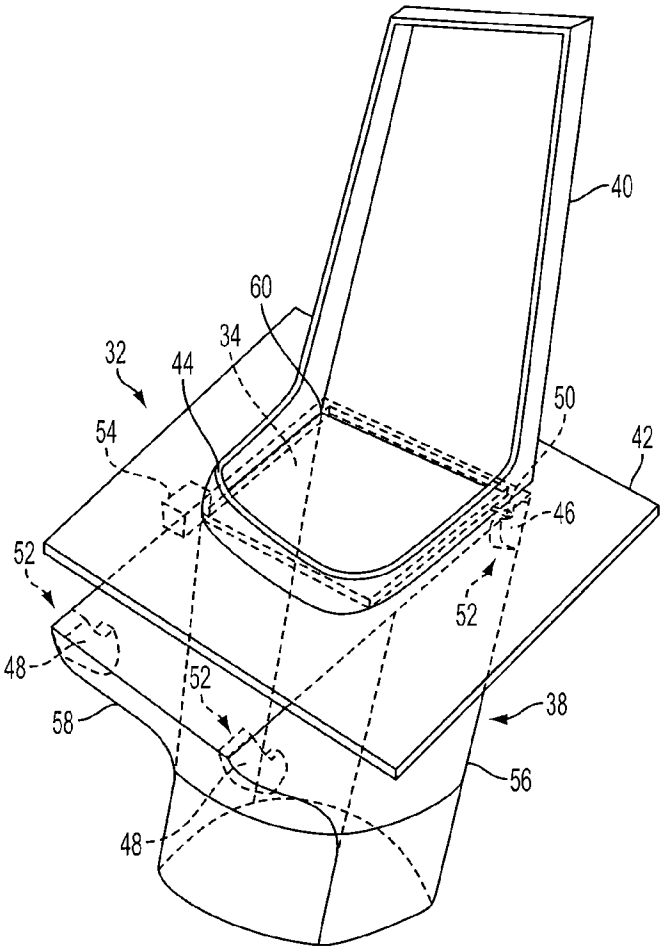
FIG. 4 is a perspective view of a trapdoor mechanism according to an embodiment of the present invention.

FIG. 4 illustrates the trapdoor mechanism 32 of FIG. 3, without the rider 36 being positioned on the platform 34. A stop 60 is shown in FIG. 4, comprising a lip that prevents upward movement of the platform 34. In other embodiments, the stop 60 may comprise a bumper, or series of flanges, or other stopping mechanisms, which prevent upward movement of the platform 34.

Figure 5:
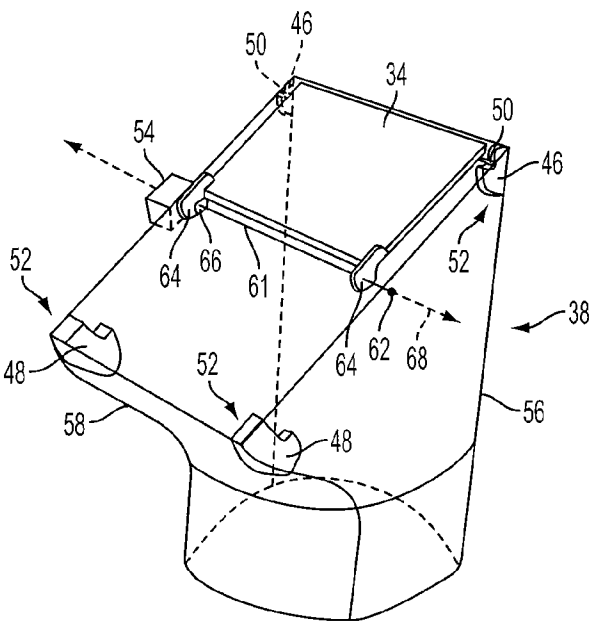
FIG. 5 is a perspective view of a trapdoor mechanism according to an embodiment of the present invention.

FIG. 5 illustrates a perspective schematic view of FIG. 4, if the stage 42, support rest 40, and retainer 44 of the trapdoor mechanism 32 had been removed, and the walls of the slide segment 56 had been made transparent. FIG. 5 illustrates in this embodiment the platform 34 has a proximal end and a distal end. The proximal end is secured to a pivot 61, about which the platform 34 may pivot. The pivot 61 is connected to bearings 62, allowing the pivot 61 to rotate with the motion of the platform 34. The pivot 61 is shown in FIG. 5 as a rod the platform 34 pivots about. In other embodiments, the pivot 61 may comprise a swivel, a gear, an axle, or any other device the platform 34 pivots about. Linkages 64 connect the pivot 61 to the proximal end of the platform 34. A component of the control device 54 comprising an actuator 66, is additionally positioned at the proximal end of the platform 34, and may actuate locks 50 of the securing devices 52, as desired.

The distal end of the platform 34 is held in position by the securing devices 52. The lock 50 is positioned upon the closed position supports 46 to hold the distal end of the platform 34 in a secure position. In the embodiment shown in FIG. 5, the lock 50 comprises a roller, shaped to be received by both the closed position supports 46 and the open position supports 48. In addition, the closed position supports 46 and the open position supports 48 are each shaped as brackets, each having a receiving surface configured to receive the lock 50. The lock 50 and closed position supports 46 are configured to support the weight of a rider, or riders who may be positioned upon the platform 34 when it is in the closed position. The lock 50 and open position supports 48 are configured to retain the platform 34 in the open position, such that it does not swing back to the closed position unless so desired.

In operation, the platform 34 is configured to move, rotate, or pivot about an axis of rotation 68 from a closed position (or first position) to an open position (or second position), to allow a rider (for example the rider 36 shown in FIG. 3) to descend into the entrance 38 of the slide segment 56. The platform 34 pivots around the pivot 61 as it moves from the closed position to the open position. The platform 34 may be oriented at a variety of open positions (second positions) upon the platform's 34 transit to the open position shown in FIG. 7, the open position being a position that allows the rider to enter the slide ride. The open position shown in FIGS. 6 and 7, for example, represents an open position at which the platform is at rest, or has no momentum.

To initiate movement of the platform 34, the actuator 66 of the control device 54 causes the securing mechanisms 52 holding the platform 34 in the closed position, to unlock. In the embodiment of FIG. 5, the lock 50 disengages from the closed position supports 46 to release the platform 34 from the secure position.

Once the platform 34 is released, it is capable of pivoting about the pivot 61. The force of gravity exerted against the platform 34 causes the platform to swing downward. The platform 34 develops momentum, particularly angular momentum, caused by the force of gravity exerted upon the platform 34. The angular momentum conveys the platform 34 to the open position, in which the lock 50 engages the open position supports 48. The securing devices 52 at the platform's 34 open position retain the platform 34 for a duration sufficient that the rider drops into, or through the entrance 38 of the slide segment 56.

Figure 6:
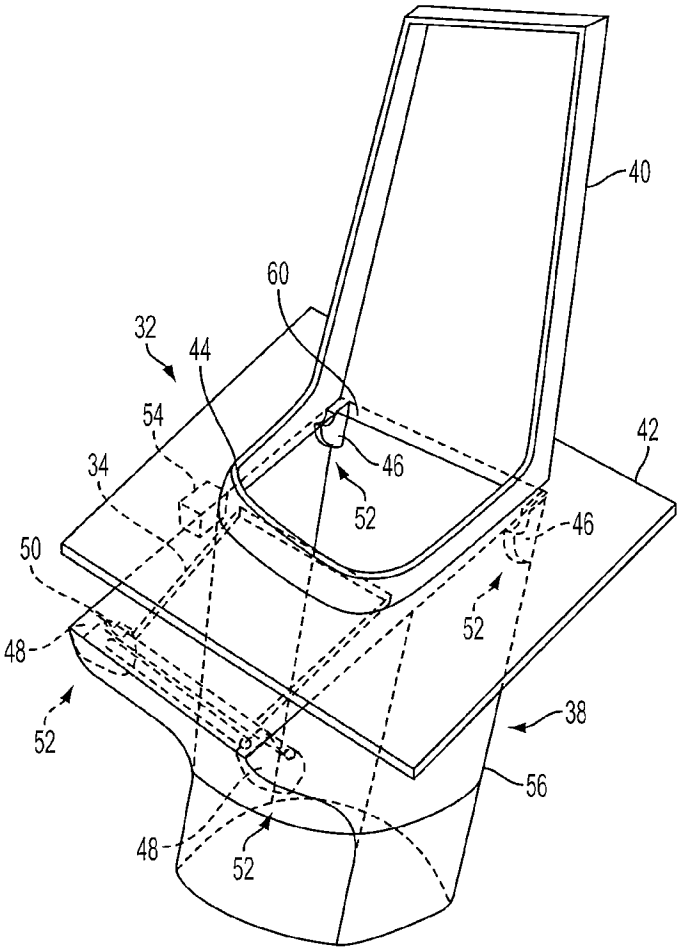
FIG. 6 is a perspective view of a trapdoor mechanism according to an embodiment of the present invention.

FIG. 6 is a representation of the trapdoor mechanism 32 in which the platform 34 is in the open position. In this configuration, the distal end of the platform 34 is held in position by the lock 50 engaging the open position supports 48. A rider may therefore descend into the slide ride, after having been positioned upon the platform 34. FIG. 6 more clearly illustrates the stop 60, comprising a lip that prevents upward movement of the platform 34 when the platform 34 returns to the closed position from the open position.

Figure 7:
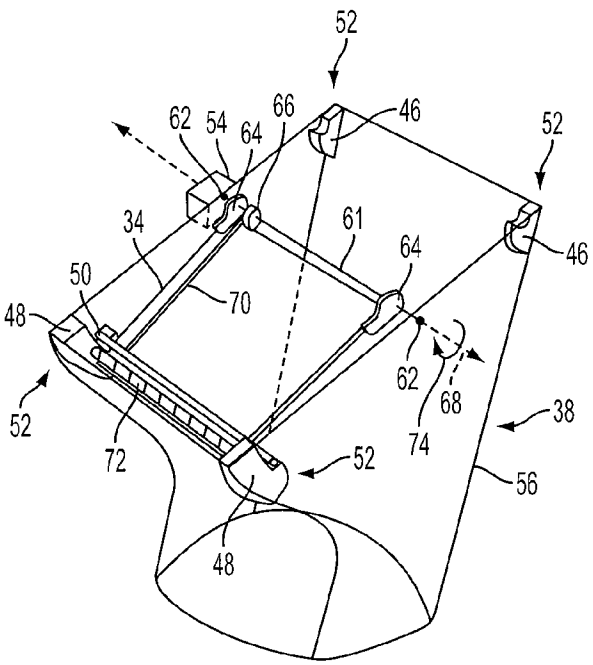
FIG. 7 is a perspective view of a trapdoor mechanism according to an embodiment of the present invention.

FIG. 7 illustrates a perspective schematic view of FIG. 6, if the stage 42, support rest 40, and retainer 44 of the trapdoor mechanism 32 had been removed, and the walls of the slide segment 56 had been made transparent. FIG. 7 illustrates the lock 50 comprises a roller that rests upon a receiving surface of the open position supports 48. The lock 50 is connected to the actuator 66 with a coupler 70 comprising a rod which may be capable of pushing and/or pulling the lock 50.

The lock 50 and open position supports 48 are configured such that the lock 50 automatically engages the open position supports 48 upon the platform 34 reaching the open position. As shown in FIG. 7, the open position supports 48 are shaped with a taper, such that the lock 50 is automatically displaced when the platform 34 rotates, or is rotatably conveyed by the force of gravity or a control device 54 (shown in FIG. 5 for example), to the open position. The receiving surface of the open position supports 48 then secures the lock 50 in position. Accordingly, an automatic securing device 52 holds the platform 34 in the open position.

FIG. 7 additionally illustrates a bumper 72 is configured to cushion the platform 34, in case the platform 34 overshoots the open position supports 48, in certain embodiments. The bumper 72 may comprise a rail, a pad, or other device capable of stopping the motion of the platform 34.

FIG. 7 further illustrates an arrow 74 indicating the direction of rotation the platform 34 traveled to reach the orientation shown in FIG. 7, from the orientation shown in FIGS. 4 and 5.

In operation, to return the platform 34 from the open position shown in FIG. 7 back to the orientation shown in FIG. 5, the actuator 66 first causes the securing mechanism lock 50 to disengage from the open position supports 48. The actuator 66 may pull on the coupler 70, causing the lock 50 to retract and unlock from the receiving surface of the open position supports 48. The platform 34 is then configured to swing back to the closed position based upon the force of gravity exerted upon the platform 34.

The force of gravity against the platform 34 again causes the platform to swing downward. The platform 34 develops momentum, in the form of angular momentum, caused by the force of gravity exerted upon the platform 34. The momentum conveys the platform 34 back to the closed position shown in FIG. 5. Similar to the lock 50 and open position supports 48, the lock 50 and closed position supports 46 are configured such that the lock 50 automatically engages the closed position supports 46 upon the platform 34 reaching the closed position. As shown in FIG. 7, the closed position supports 46 are shaped with a taper, such that the lock 50 is automatically displaced when the platform 34 rotates to the closed position. The receiving surface of the closed position supports 46 then secures the lock 50 in position. Accordingly, an automatic securing device 52 holds the platform 34 in the closed position.

FIGS. 8A-8J illustrate a sequence of the path of the platform 34 from the closed position (as shown in FIGS. 4 and 5) to the open position (as shown in FIGS. 6 and 7), and back to the closed position (as shown in FIGS. 4 and 5). FIGS. 8A-8J illustrate a cross sectional view of the trapdoor mechanism 32 shown in FIG. 4, for example, taken along a line approximately halfway through the width of the support rest 40. Differences in the level of detail of FIGS. 8A-8J relative to FIGS. 4-7 may be apparent from the FIGS. FIGS. 8A-8J do not illustrate the stage 42 shown, for example, in FIG. 4.

Figure 8A:
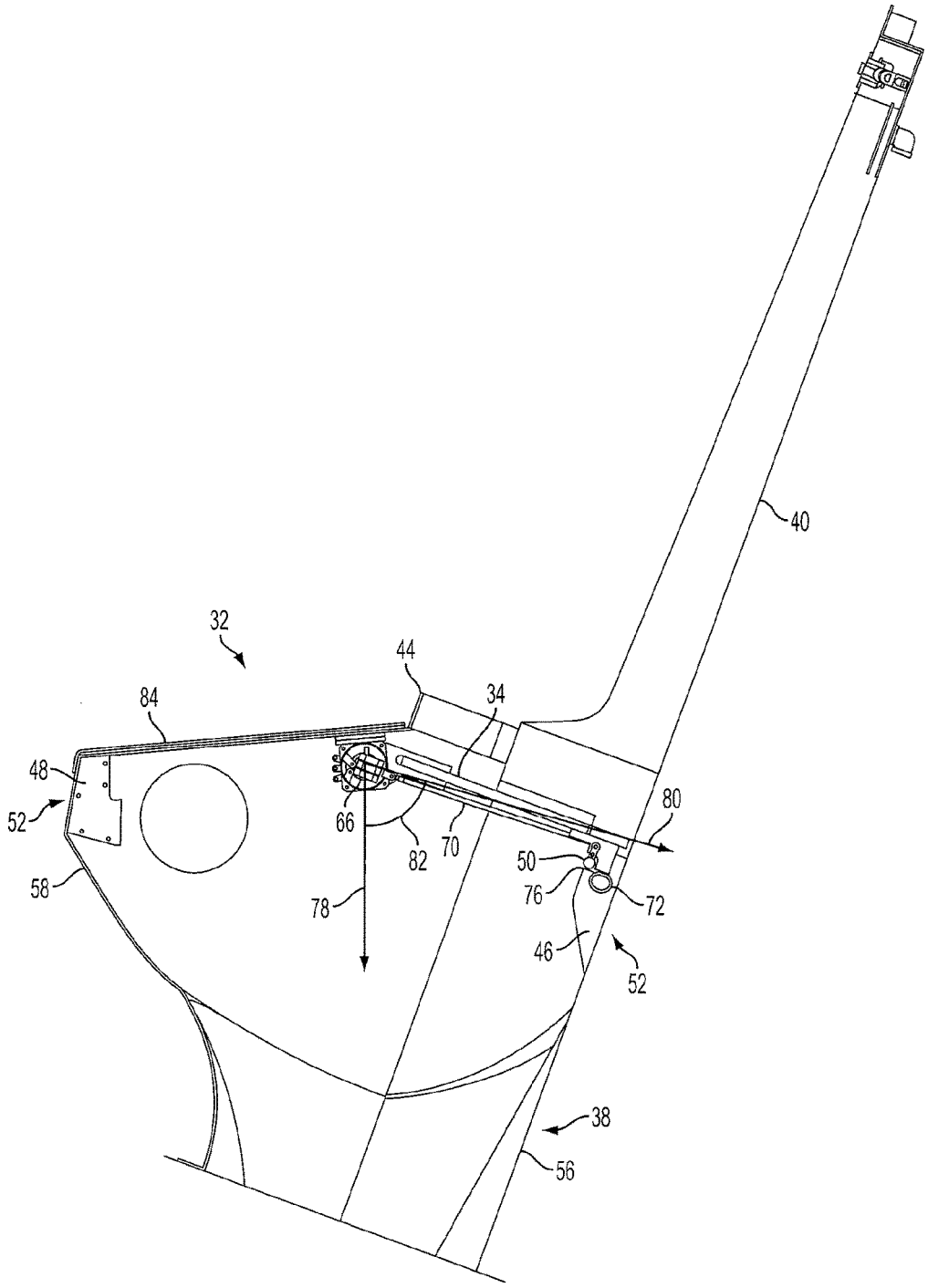
FIGS. 8A-8J show a side cross sectional view of a trapdoor mechanism according to an embodiment of the present invention, taken along a line substantially at a middle of the trapdoor mechanism.

FIG. 8A illustrates the trapdoor mechanism 32 in the closed position, for example, in the position shown in FIGS. 3-5. The lock 50 is shown secured upon the receiving surface 76 of the closed position supports 46.

An arrow represents the direction 78 of the force of gravity upon the axis of rotation 68 (shown in FIGS. 5 and 7) and the pivot 61 (shown in FIGS. 5 and 7) around which the platform 34 rotates. An arrow represents a direction 80 defined by the orientation of the platform 34 relative to the pivot 61 (shown in FIGS. 5 and 7). The angle 82 defines the angle of the platform 34 relative to the direction 78 of the force of gravity upon the pivot 61. The angle 82 defines the angle of the platform 34 in the closed position (or first position).

FIG. 8A additionally illustrates a lid 84 enclosing the recess 58 of the slide segment 56.

Figure 8B:
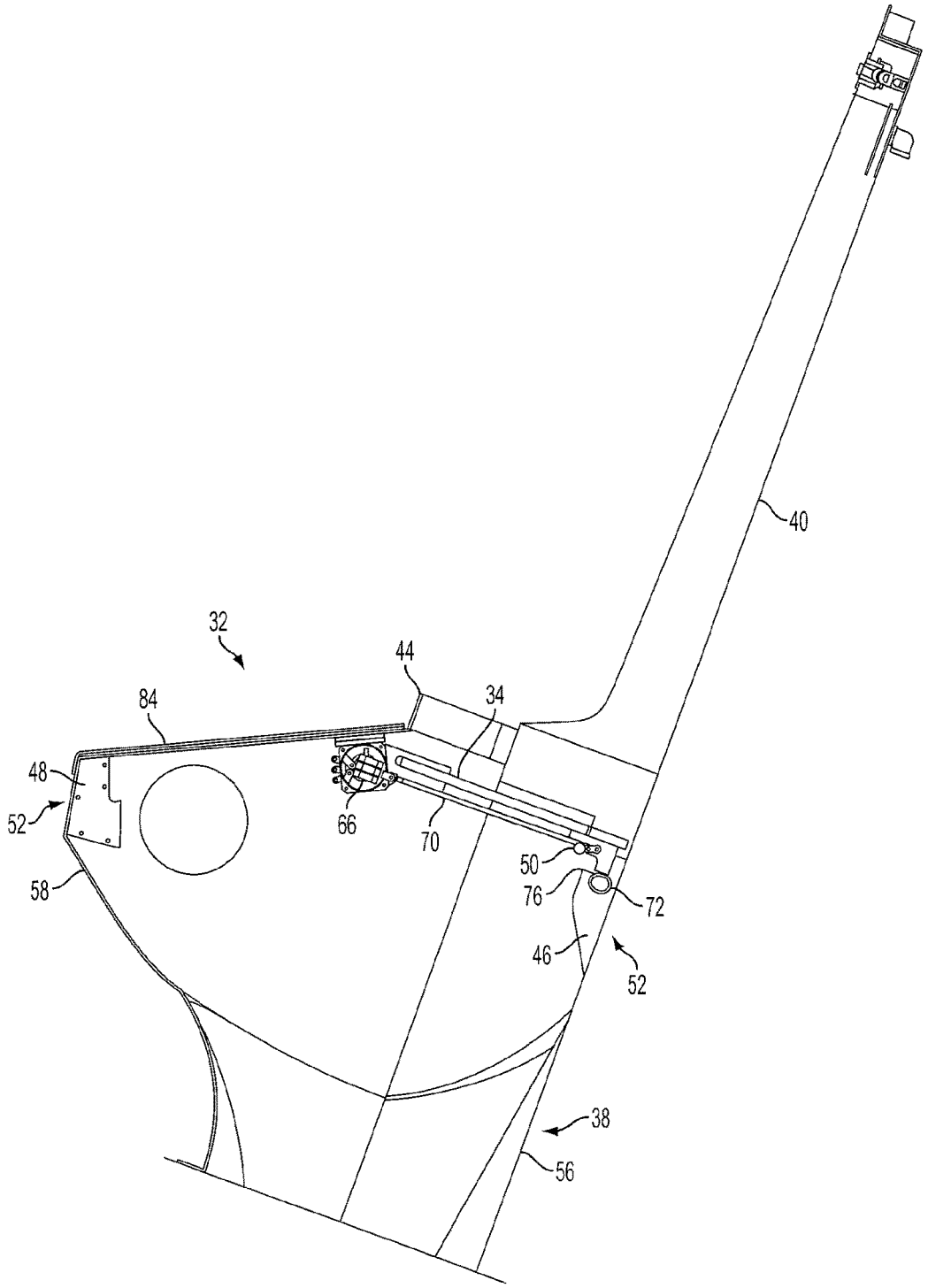

FIG. 8B illustrates the lock 50 being disengaged, or unlocked, from the closed position supports 46. The actuator 66 retracts the coupler 70, which causes the lock 50 to pivot away from the receiving surface 76 of the closed position supports 46. The securing device 52 is therefore unlocked, and the platform 34 is capable of swinging downward due to the force of gravity exerted upon the platform 34.

Figure 8D:
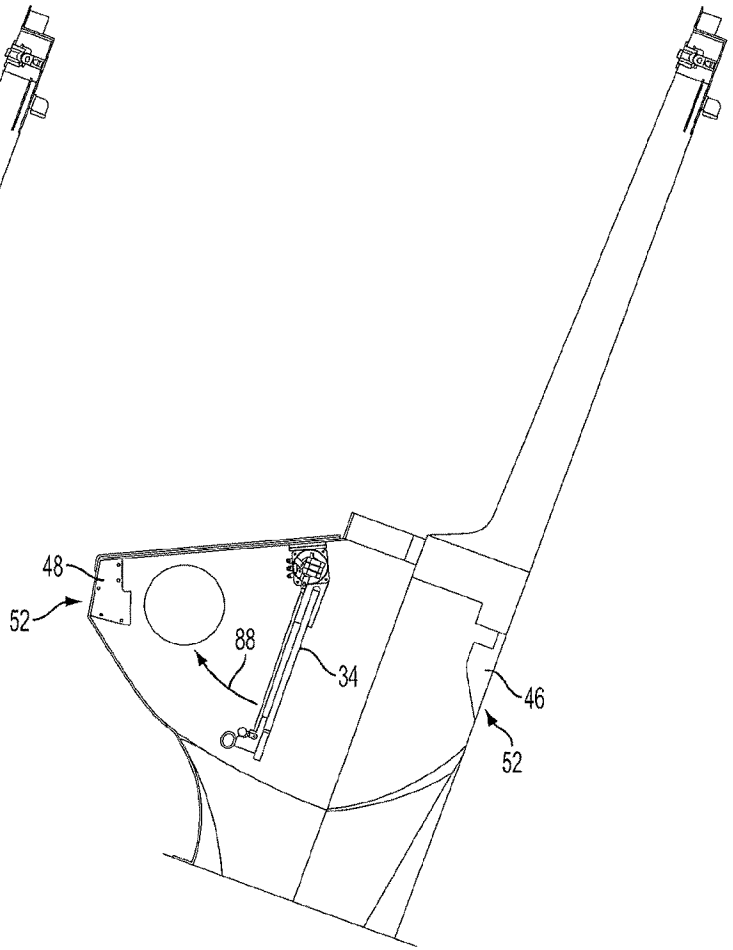
Figure 8C:
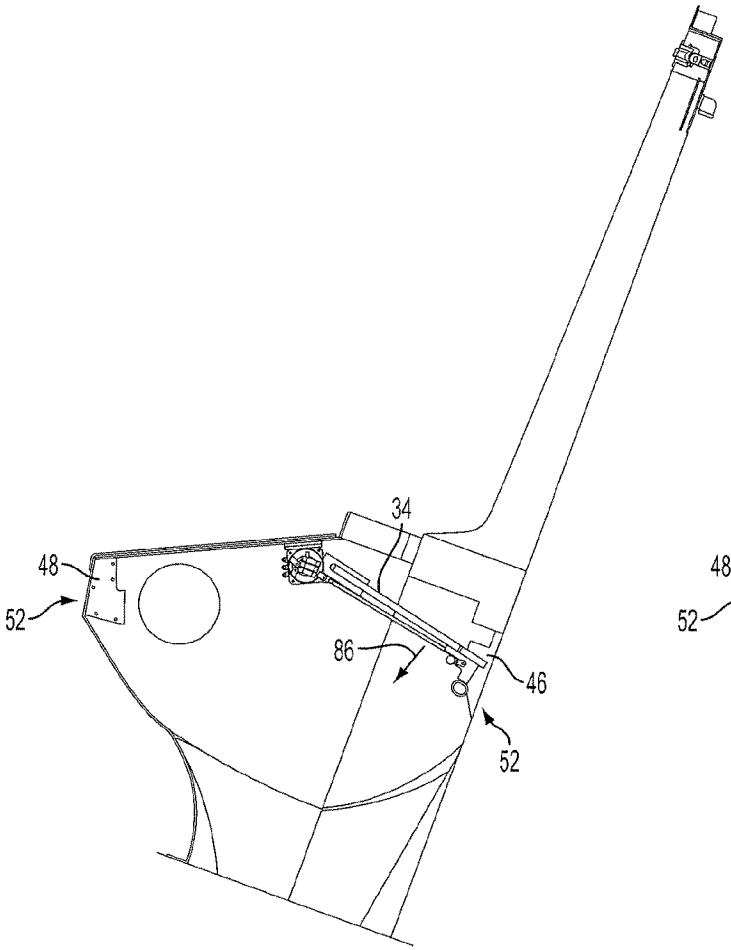

FIG. 8C illustrates the platform 34 after it has begun to move due to the force of gravity exerted against the platform 34. The force of gravity produces a momentum indicated by arrow 86, which conveys the platform 34 towards the open position.

FIG. 8D illustrates the platform 34 after it has continued to rotate to the open position. Arrow 88 indicates the momentum produced by the force of gravity, which is larger than that shown in FIG. 8C.

Figure 8F:
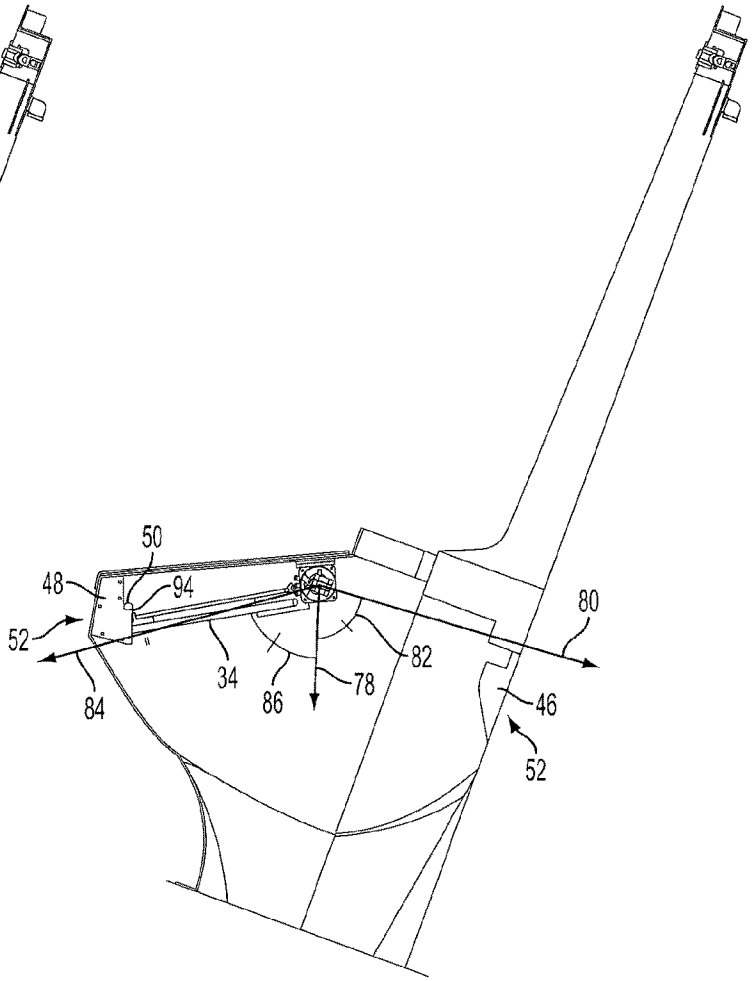
Figure 8E:
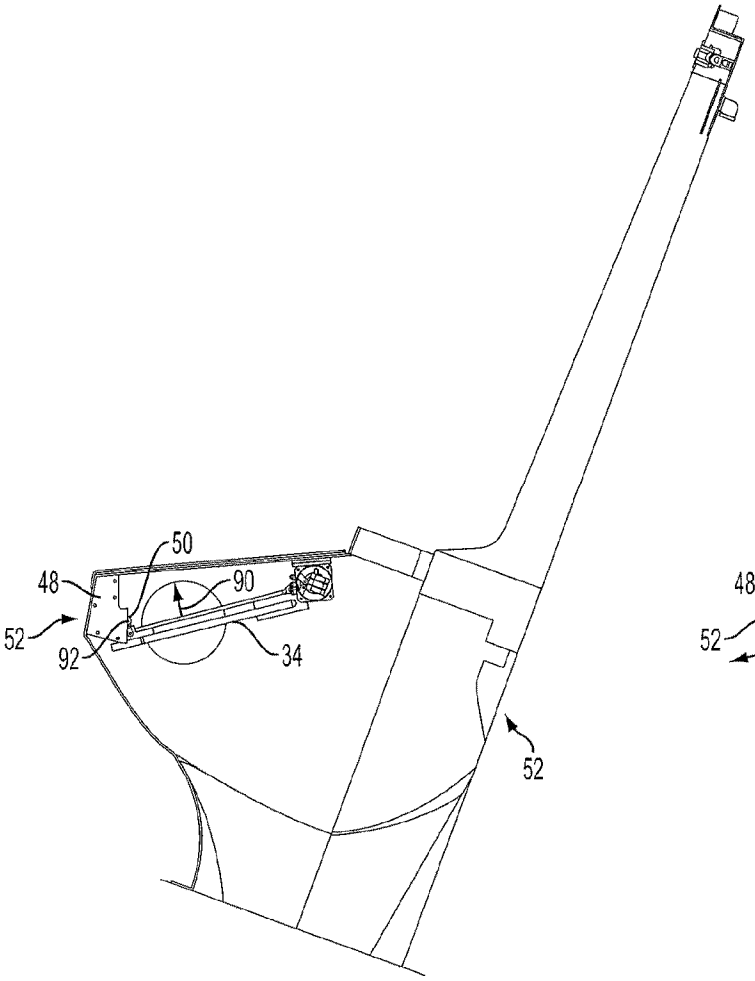

FIG. 8E illustrates the platform 34 after it has nearly reached the open position. The arrow 90 indicates the momentum produced by the force of gravity, which is smaller than that shown in FIG. 8D. The lock 50 at this point may be displaced by the tapered surface 92 of the open position supports 48.

FIG. 8F illustrates the platform 34 after it has reached the open position, the position shown in FIGS. 6 and 7, for example. The lock 50 rests upon the receiving surfaces 94 of the open position supports 48, securing it in position. The lock 50 was automatically displaced was positioned on the open position supports 48, serving as an automatic locking mechanism.

FIG. 8F additionally illustrates the angular orientation of the platform 34 in the open position, relative to the platform's 34 angular orientation in the closed position. An arrow represents a direction 84 defined by the orientation of the platform 34 relative to the pivot 61 (shown in FIGS. 5 and 7) in the open position. The angle 86 defines the angle of the platform 34 relative to the direction 78 of the force of gravity upon the pivot 61. The angle 86 of the platform 34 in the open position is identical to the angle 82 of the platform 34 in the closed position. The angle defined by the direction 78 of the force of gravity upon the pivot 61 (shown in FIGS. 5 and 7) therefore bisects the two angles 82, 86 of the platform 34 in the closed position and open position, respectively. The platform 34 at each of the angles 82, 86 is drawn to the direction 78 of the force of gravity upon the pivot 61 by the force of gravity.

In one embodiment, the moment of inertia of the platform 34 is set such that the frictional forces due to air resistance, and mechanical friction about the pivot 61 (shown in FIGS. 5 and 7) is negligible. In this embodiment, the platform 34 may have a weight of approximately thirty to eighty pounds, although this amount may be varied as desired. The weight is distributed in a manner such that the platform 34 reaches the open position (shown in FIG. 8F) from the closed position (shown in FIG. 8A) solely due to the force of gravity upon the platform 34. Thus, the gravitational potential energy held by the platform 34 in FIG. 8A is effectively conserved and effectively equal when the platform 34 reaches the open position shown in FIG. 8F.

In other embodiments, the frictional losses of the platform 34 during motion from the closed position to the open position may be such that small frictional losses reduce the angle 86 the platform 34 may achieve. In these embodiments, the direction 78 defining the angle of the force of gravity upon the pivot 61 (shown in FIGS. 5 and 7) may only at least approximately serve as a bisector of angles 82, 86.

Figure 8H:
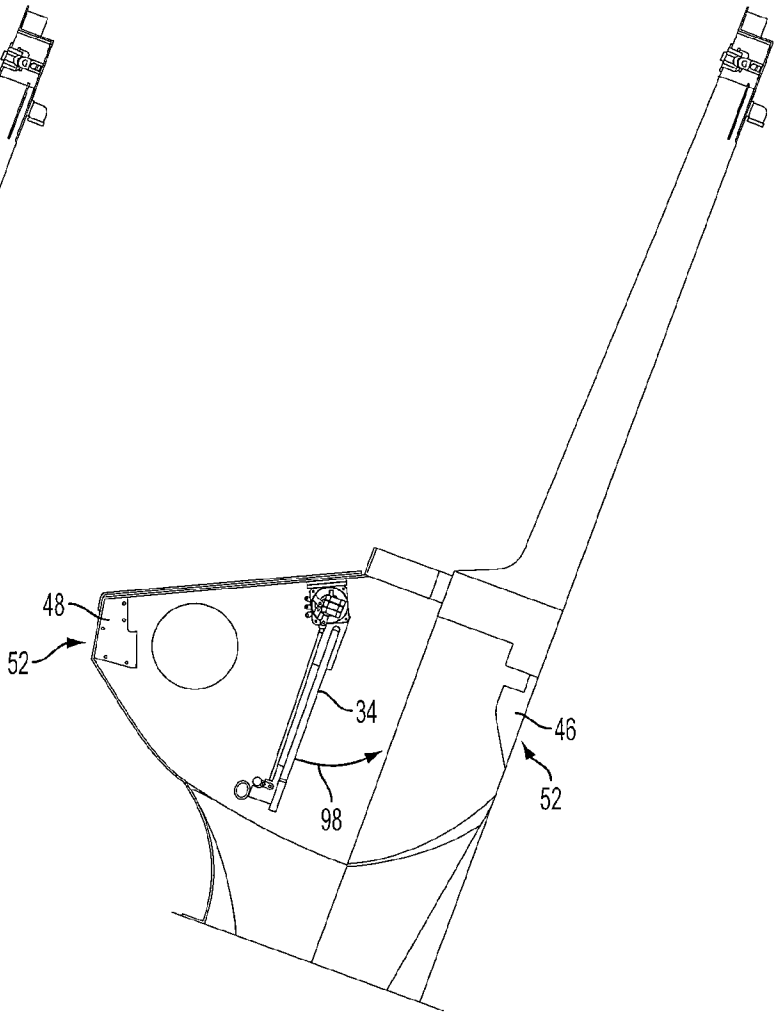
Figure 8G:
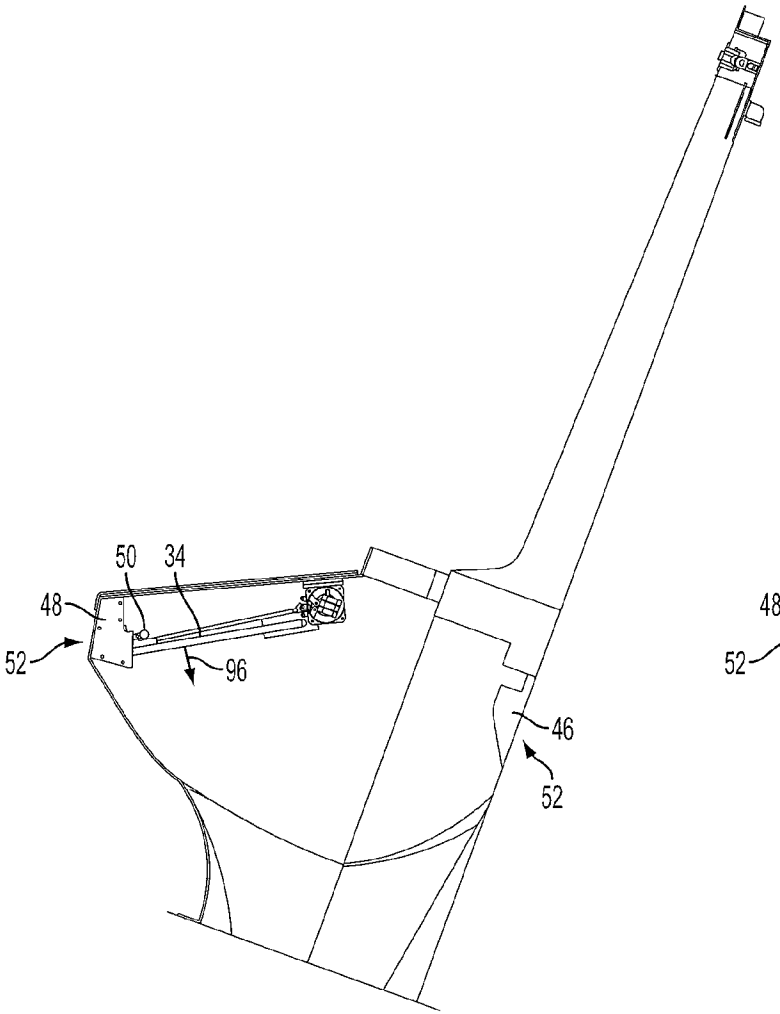

FIGS. 8G-8J illustrate the return of the platform 34 to the closed position shown in FIG. 8A. FIG. 8G illustrates the platform 34 after the lock 50 has been disengaged from the open position supports 48. The force of gravity exerted against the platform 34 forms momentum indicated by arrow 96, conveying the platform 34 from the open position to the closed position.

FIG. 8H illustrates the platform 34 continuing on a path to the closed position. Arrow 98 illustrates the momentum of the platform 34, which is greater than the momentum shown in FIG. 8G by arrow 96.

Figure 8J:
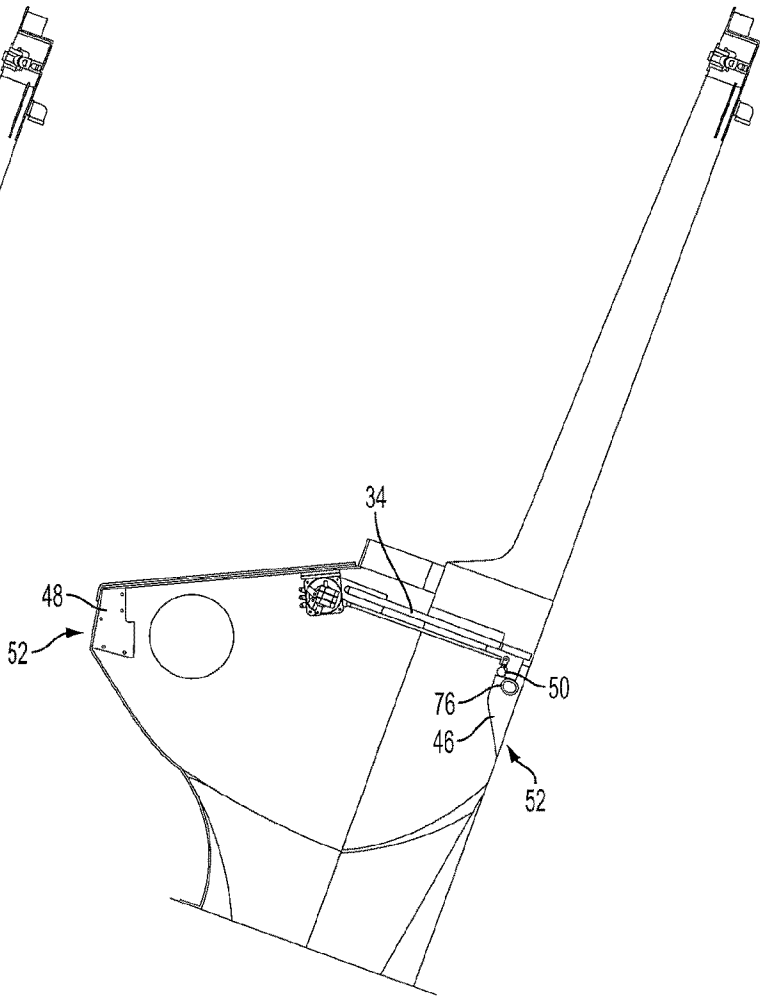
Figure 8I:
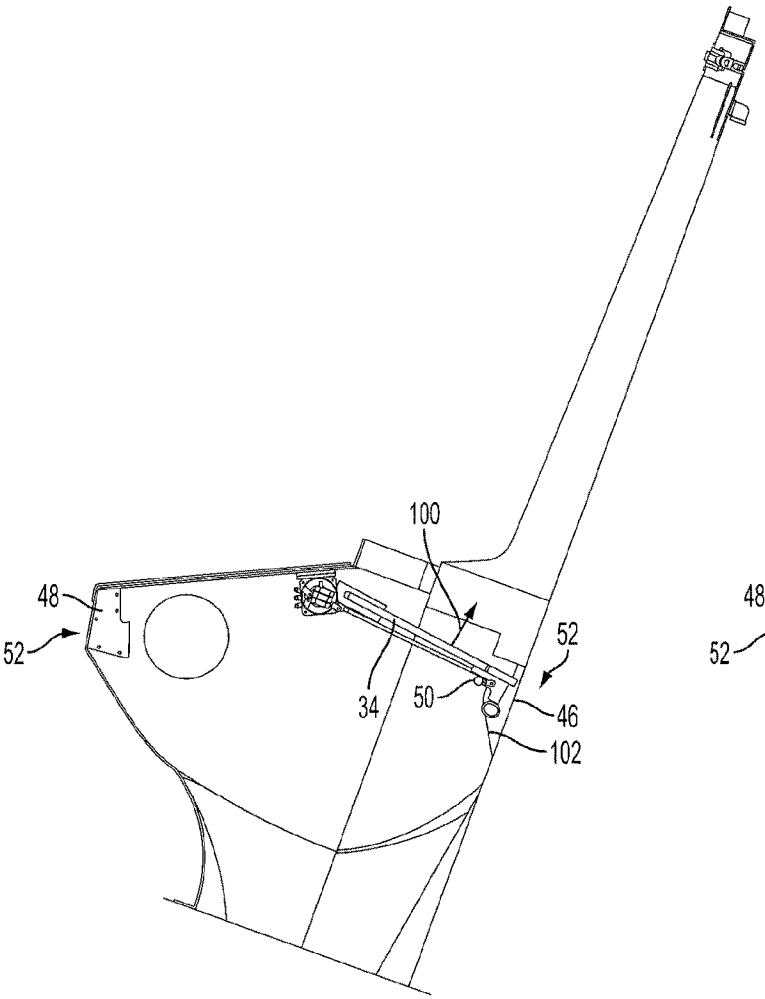

FIG. 8I illustrates the platform 34 as it approaches the closed position. The lock 50 has been displaced by the taper 102 of the closed position supports 46. Arrow 100 illustrates the momentum of the platform 34, which is less than the momentum shown in FIG. 8H by arrow 98.

FIG. 8J illustrates the platform 34 after it has reached the closed position, the position shown in FIG. 8A, for example. The lock 50 rests upon the receiving surfaces 76 of the closed position supports 46, securing it in position. The lock 50 was automatically displaced upon being positioned on the closed position supports 46, the securing device 52 serving as an automatic locking mechanism.

In the sequence shown in FIGS. 8A-8J, the frictional losses experienced by the platform 34 may be insufficient to prevent the platform from moving between the closed position and the open position effectively, based solely upon the force of gravity exerted upon the platform 34. For example, in one embodiment, the moment of inertia of the platform 34 may be sufficiently large to render frictional forces negligible.

In other embodiments, the frictional losses may be large enough to prevent the platform 34 from effectively moving between the closed position and the open position, solely utilizing the force of gravity exerted upon the platform 34. In other words, frictional losses may prevent sufficient momentum from being attained to allow the platform 34 to reach the heights, or angles, shown in FIGS. 8A and 8F, for example. To account for these frictional losses, a control device 54 (shown in FIGS. 5, 7, and 15, for example) may be used to assist the platform 34 to reach the open position from the closed position, and the closed position from the open position.

Referring to FIG. 5, the control device 54 may include a force generator configured to move the platform 34 to various positions. The force generator may comprise a motor, or a series of springs, or any other device capable of producing a force against the platform 34. The control device 54 may be configured to apply a force to the platform 34 to overcome the frictional losses experienced by the platform 34, to allow the platform 34 to effectively reach the open position from the closed position, and the closed position from the open position, as if though no frictional losses were present.

The control device 54 may be timed to only apply a force to the platform 34 when the platform 34 has its greatest momentum. Such a momentum may be achieved when the platform 34 is at a position close, or identical, to the angular position represented by the arrow 78 in FIGS. 8A and 8F. At this point, the platform 34 may have its greatest kinetic energy due to the gravitational potential energy acquired when the platform 34 was in the respective closed position or open position. The control device 54 may therefore efficiently apply a force, or torque as applicable in the embodiment, shown in FIG. 5, for example, to move the platform 34 to the open position from the closed position, and the closed position from the open position. In certain embodiments, the control device 54 may be configured to apply a force harmonically, at the natural frequency, or resonance frequency, of the platform 34. In certain embodiments, the control device 54 in conjunction with the platform 34 may form a damped driven oscillator.

In certain embodiments, the control device 54 may apply a force that is insufficient to convey the platform 34 to move to the open position from the closed position, and to the closed position from the open position. The control device 54 may exert a force against the platform 34, although the force of gravity may produce the momentum that primarily conveys the platform 34 between the closed position and open position. In these embodiments, the moment of inertia, or mass distribution, of the platform 34 may be too great to cause the platform 34 to move between the open position and the closed position, solely based upon the force of the control device 54, and not accounting for the momentum produced by the gravitational force upon the platform 34. In other words, the kinetic energy imparted to the platform 34 by the control device 54 may be insufficient to convey the platform 34 between the open position and the closed position, without accounting for the additional energy provided by the gravitational potential energy of the platform 34 when it is in the open position or closed position. The gravitational potential energy of the platform 34 combined with the kinetic energy provided by the control device 54 is sufficient to convey the platform 34 between the open position and the closed position. In this manner, the control device 54 operates efficiently, by producing a minimal force sufficient to only overcome frictional losses exerted against the platform 34. The platform 34 therefore is conveyed between the first position and the second position in part by momentum produced by the force of gravity exerted against the platform 34 and in part by momentum produced by the control device 54 exerting a force against the platform 34.

In other embodiments, the control device 54 may be configured to constantly apply a force to the platform 34, and not to apply a force in a timed manner. In other embodiments, the control device 54 may be configured to apply a large force to the platform 34, greater than that necessary to only overcome frictional losses, in a timed manner. In other embodiments, the control device 54 may be configured to apply a large force constantly to the platform 34, greater than that necessary to only overcome frictional losses, and not to apply a force in a timed manner.

FIGS. 9A-9D illustrate an embodiment in which frictional losses are sufficient to prevent the platform 34 from moving between the open position and the closed position based solely upon the force of gravity. In this embodiment, the moment of inertia of the platform 34 is insufficient to render frictional forces negligible. Such frictional forces may stem from air resistance, or mechanical frictional losses caused by the pivot 61 (shown in FIGS. 5 and 7, for example).

Figure 9B:
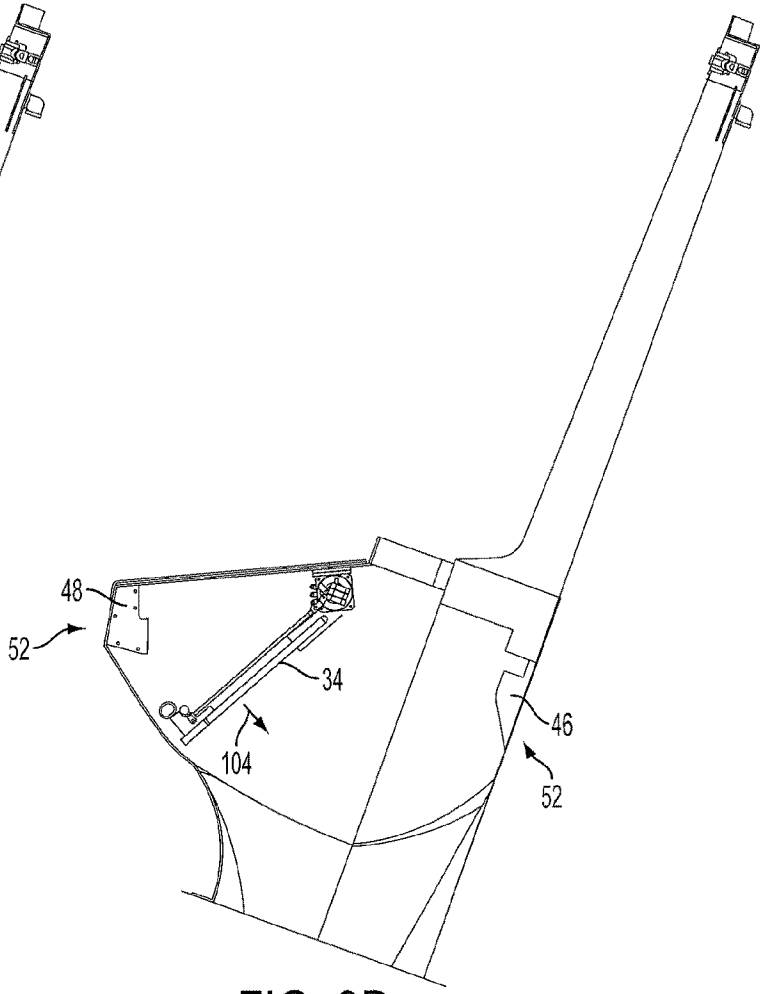
FIGS. 9A-9D show a side cross sectional view of a trapdoor mechanism according to an embodiment of the present invention, taken along a line substantially at a middle of the trapdoor mechanism.
Figure 9A:
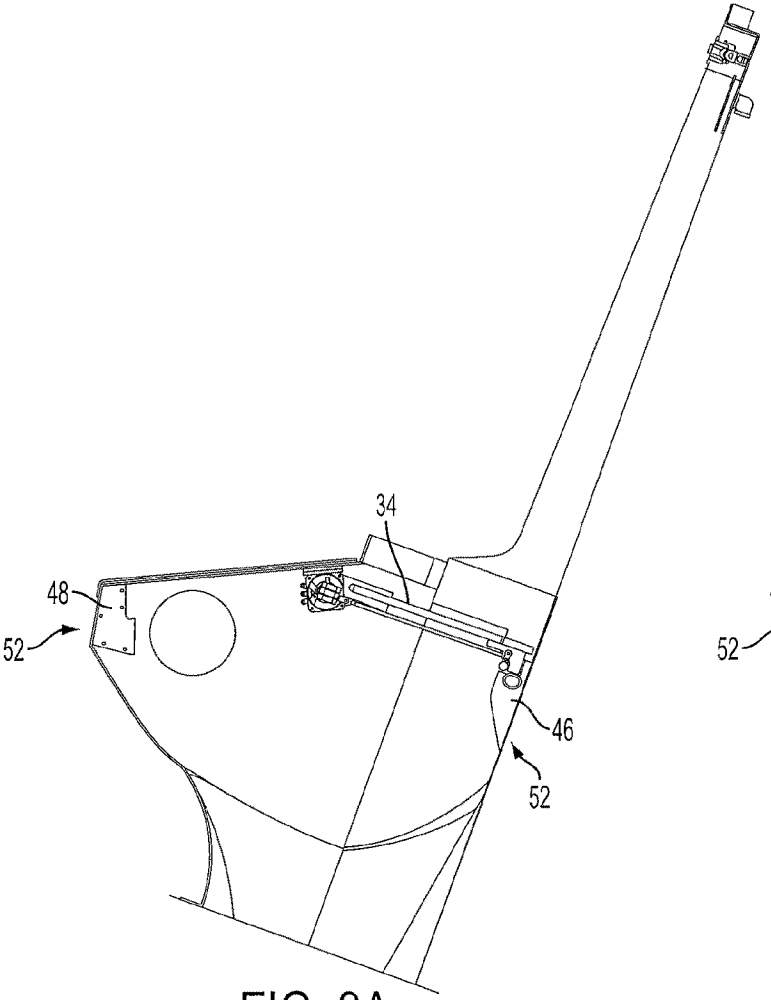
Figure 9D:
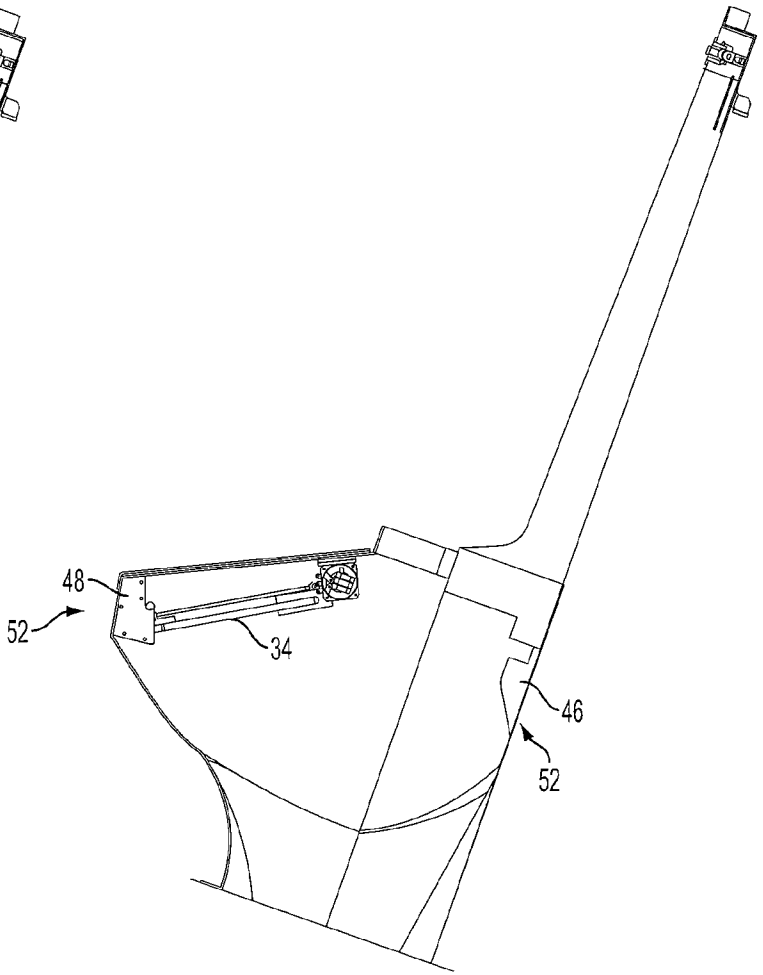

In FIG. 9A the platform 34 is shown in the closed position. Once the securing device 52 unlocks the platform 34 from the closed position, the platform 34 will begin to rotate towards the open position. However, frictional losses prevent the platform 34 from reaching the open position, shown, for example, in FIG. 8F. In this embodiment, the platform 34 may only reach a position shown in FIG. 9B, for example. In other embodiments, the platform 34 may reach varied angular positions, as desired, upon the securing device 52 being unlocked.

Upon the platform 34 reaching a height shown in FIG. 9B, for example, a gravitational force will begin to produce a momentum indicated by arrow 104, for example, in a direction toward the closed position shown in FIG. 9A. Once the platform 34 begins to rotate toward the closed position, the control device 54, shown in FIG. 5, for example, may exert a force, specifically a torque, on the platform 34. The combined kinetic energy added by the control device 54 and the gravitational potential energy of the platform 34 at the height shown in FIG. 9B may be sufficient to raise the platform 34 to a height shown in FIG. 9C. In certain embodiments, the control device 54 may apply a force when the platform 34 is approximately at the angle defined by the direction 78 arrow shown in FIGS. 8A and 8F, although the timing and strength of this force may be varied as discussed in regard to other embodiments of this application.

Figure 9C:
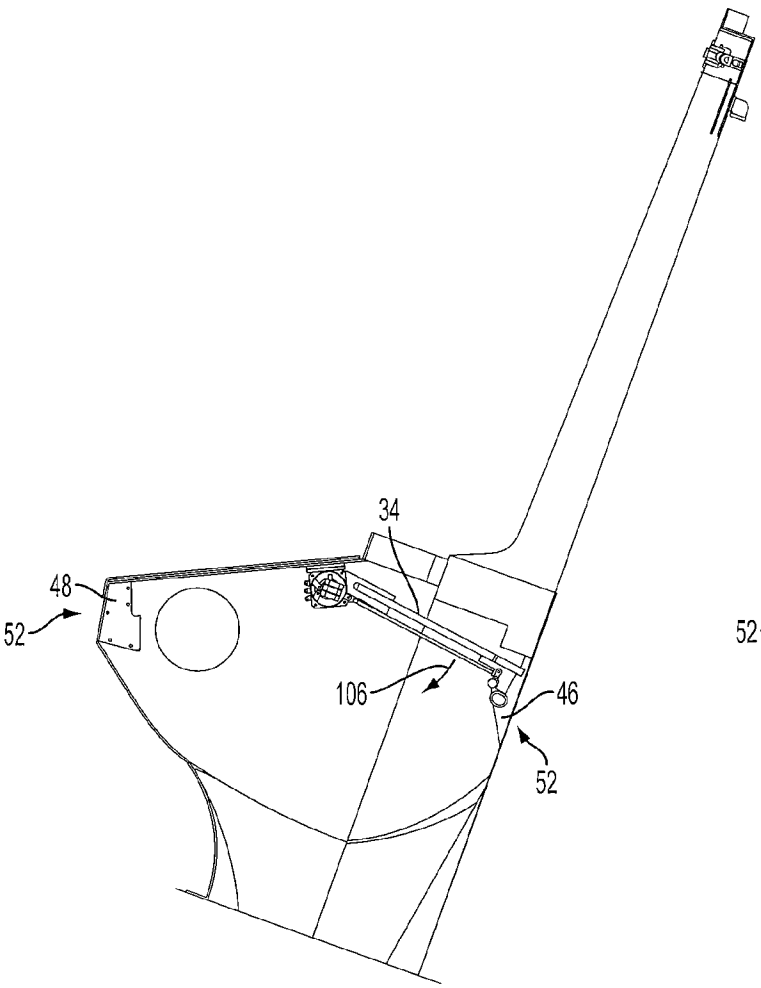

Upon the platform reaching the height shown in FIG. 9C, the force of gravity may cause the platform 34 to achieve a momentum indicated by arrow 106. The platform 34 is then drawn in a direction towards the open position. Once the platform 34 begins to rotate toward the open position, the control device 54, shown in FIG. 5, may exert a force, specifically a torque, on the platform 34. Again, in certain embodiments, the control device 54 may apply a force when the platform 34 is approximately at the angle defined by the direction 78 arrow shown in FIGS. 8A and 8F, although the timing and strength of this force may be varied as discussed in regard to other embodiments of this application. The platform 34 may then achieve a height sufficient to reach the open position shown in FIG. 9D.

In the embodiment shown in FIGS. 9A-9D, the platform 34 oscillates between varied positions, until the desired position is achieved. The number of oscillations and positions of the platform 34 at points of no momentum may be varied, as desired. The strength of the force exerted by the control device 54 shown in FIG. 5, for example, may also be varied as desired.

FIGS. 10A-10D illustrate an embodiment that does not utilize a securing mechanism to hold the platform 34 in the open position. The platform 34 continuously moves, or oscillates between the closed position and the open position without being held in an open position, by a securing device, for example. In this embodiment, the period of oscillation, or time that it takes the platform 34 to move from the closed position, to the open position, and back to the closed position, may be configured such that an individual is not capable of being hit by the platform 34 as it returns to the closed position.

Figure 10B:
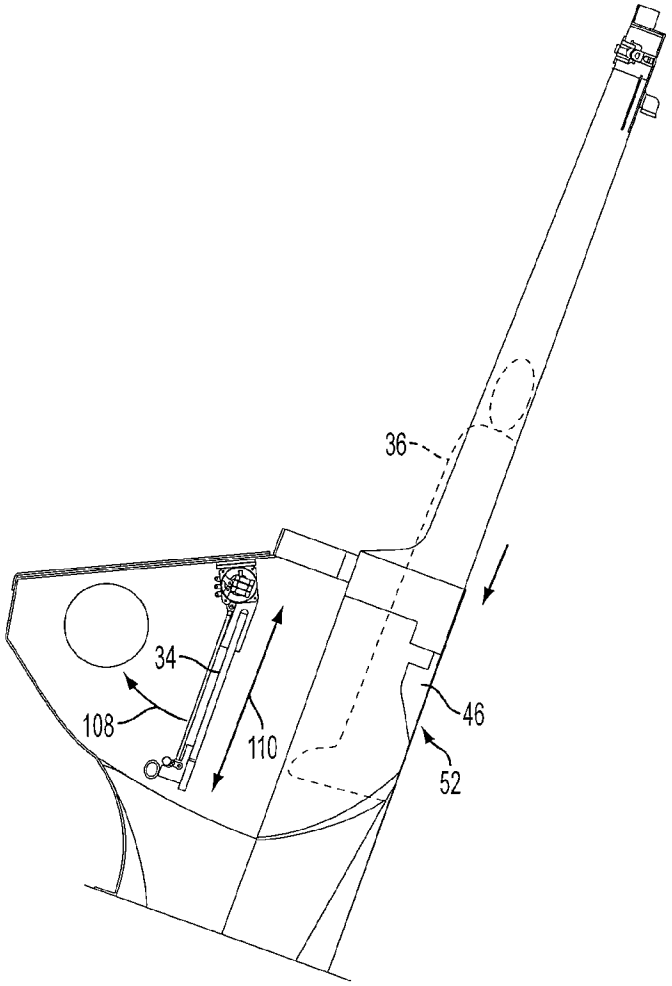
FIGS. 10A-10D show a side cross sectional view of a trapdoor mechanism according to an embodiment of the present invention, taken along a line substantially at a middle of the trapdoor mechanism.
Figure 10A:
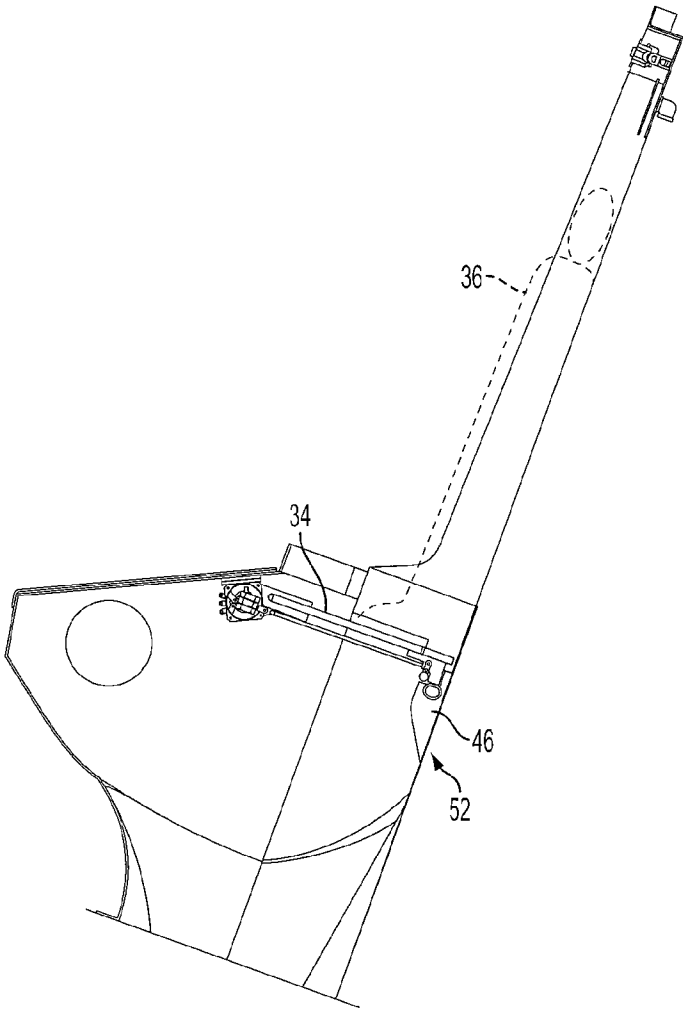

FIG. 10A illustrates the platform 34 in the closed position. An outline of the rider 36 is provided to illustrate exemplary timing of the platform 34 in this embodiment. Once the platform is unlocked by the securing mechanism 52, it begins to fall towards the open position.

FIG. 10B illustrates the platform 34 after it has rotated away from the closed position. The platform 34 has momentum caused by the force of gravity, as indicated by arrow 108. In certain embodiments, the momentum may also be produced in combination with momentum provided by the control device 54, shown in FIG. 5, for example, in a manner discussed in various embodiments in this application. In addition, as shown in FIG. 10B, the platform 34 is shown to have a length 110 from its proximal end to its distal end. FIG. 10B also illustrates the rider 36 has descended due to the force of gravity exerted upon the rider 36.

Figure 10D:
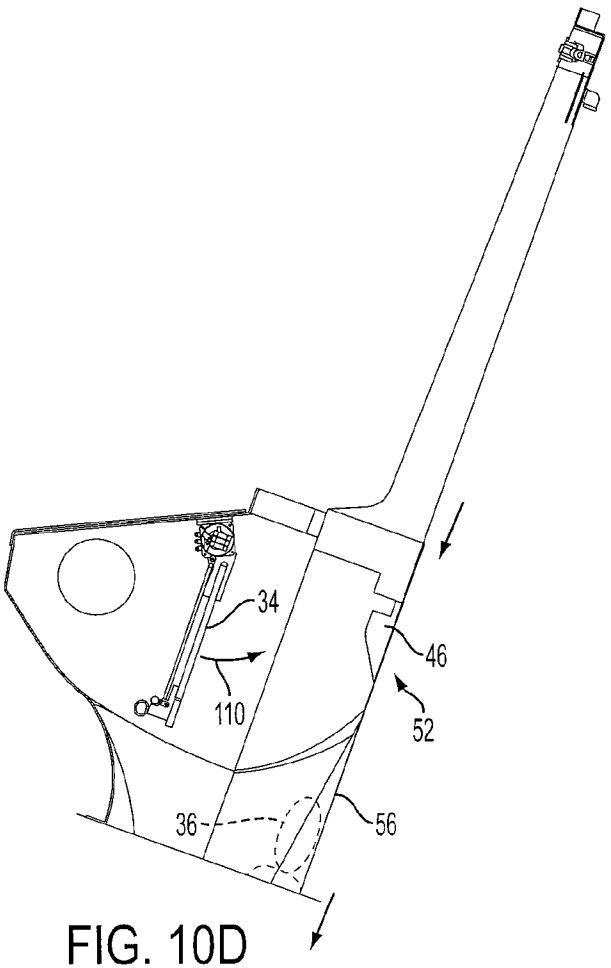
Figure 10C:
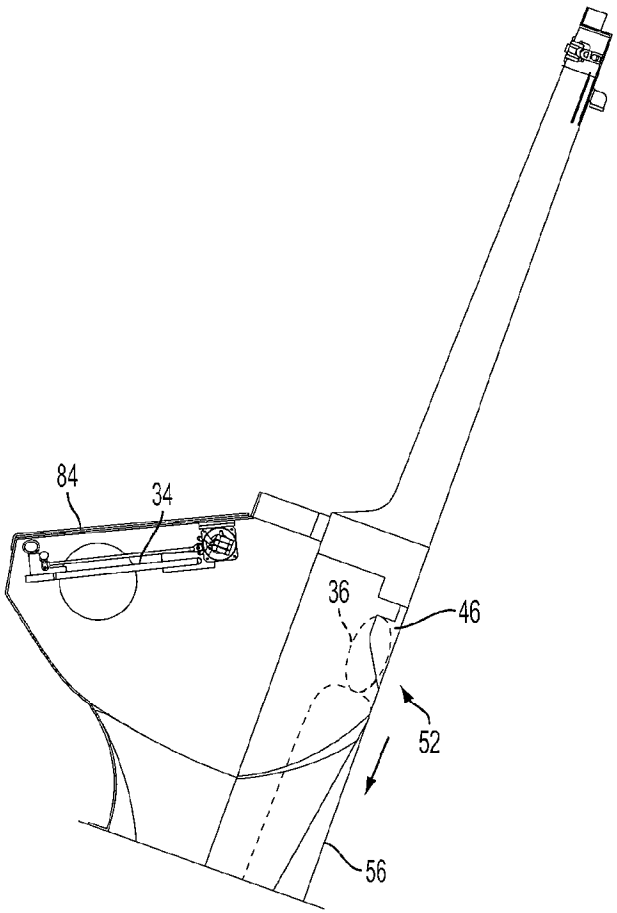

FIG. 10C illustrates the platform 34 once it is in the open position. In certain embodiments, the platform 34 may be configured such that the platform 34 does not touch the lid 84 of the slide segment 56, to prevent the motion of the platform 34 from being impeded. In other embodiments, the platform 34 may touch the lid 84. In addition, FIG. 10C illustrates the rider 36 has continued to descend into the slide segment 56 due to the force of gravity.

FIG. 10D illustrates the orientation of the platform 34 at a point at which the platform 34 may not contact the rider 36. In this orientation, the rider's 36 head is sufficiently low that the platform 34 will not contact the rider's head 36. This orientation is considered a "safe position" in which the rider will not be hit by the platform 34 returning to the closed position. The platform 34 continues to the return to the closed position shown in FIG. 10A, for example, either solely through the force of gravity, as discussed in various embodiments in this application, or through the assistance of the control device 54, as discussed in various embodiments in this application.

In order to achieve the "safe position," in which the platform 34 is not capable of hitting the rider 36, the period of the platform 34 is set to at least approximately four-thirds the time required for the rider 36 to at least descend approximately seven feet and the length 110 of the platform 34. The seven feet is approximate in nature, and may be varied as desired based on a desired height of the rider 36. For example, the height may be varied between 6 feet and 10 feet as desired, although this range is not limiting. In addition, the four-thirds is also approximate in nature, and may be varied in a manner such that the rider 36 is not hit. For example, the period may be between 1.3 times and 1.7 times the time required for the rider 36 to at least descend the height of the rider, or approximately seven feet, and the length 110 of the platform 34, although this period may be varied as desired. The period of the platform 34 may be adjusted by known means, including varying the mass distribution of the platform 34 and the length of the platform 34. Local variances in the force of gravity may be accounted for. In one embodiment, the period of the platform 34 may be adjusted by an operator adjusting the amount of friction applied to the platform 34 or varying an amount of force exerted by the control device 54 shown in FIG. 5, upon the platform 34. In this manner, a local operator may determine the height of the rider, and vary the period of the platform 34 as necessary, such that the rider is not hit. In one embodiment, the total distance the rider 36 is estimated to travel may be adjusted to account for the rider 36 gripping or sticking to a surface, to impede descent through the slide segment 56.

Figure 11:
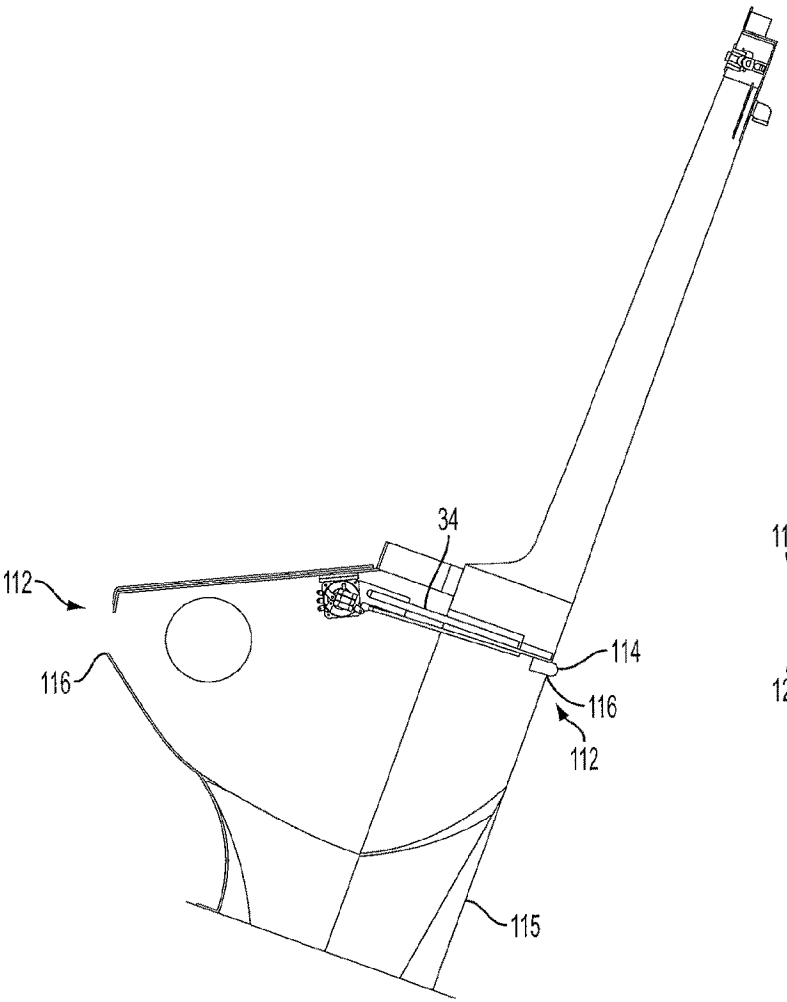
FIG. 11 shows a side cross sectional view of a trapdoor mechanism according to an embodiment of the present invention, taken along a line substantially at a middle of the trapdoor mechanism.

FIGS. 11-14 illustrate alternative embodiments of the securing devices 52 shown, for example, in FIGS. 5, 7, and 8A, for example. FIG. 11 illustrates an embodiment of a securing device 112 comprising a lock 114 in the form of a tapered pin configured to enter into a support 116 in the form of an aperture. In the embodiment shown in FIG. 11, the support 116 is positioned within a surface of a slide segment 115, which may be configured similarly as the slide segment 56 shown in FIG. 8A, for example. The securing device 112 is configured to automatically lock the platform 34 in the closed position, as shown in FIG. 11, and the open position. In operation, once the platform 34 moves to the closed position or the open position, the tapered shape of the lock 114 allows the lock to slide into the support 116, automatically securing the platform 34 in position. The lock 114 includes an untapered portion with rests against the surface of the support 116, securing the lock 114 in place. The securing device 112 is unlocked in the same manner as the securing device 52 shown in FIG. 5. For example, an actuator retracts the lock 114, causing the untapered portion of the lock 114 to disengage from the support 116 and allowing the platform 34 to fall.

Figure 12:
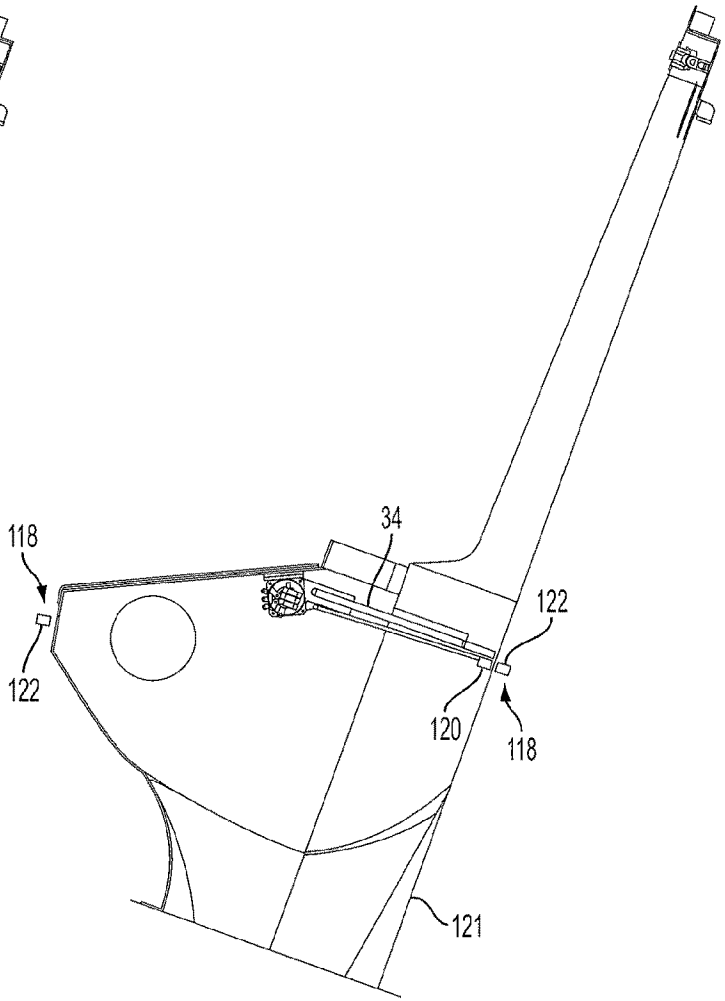
FIG. 12 shows a side cross sectional view of a trapdoor mechanism according to an embodiment of the present invention, taken along a line substantially at a middle of the trapdoor mechanism.

FIG. 12 illustrates an embodiment of a securing device 118 comprising a lock 120 in the form of an electromagnet configured to engage a support 122 in the form of a magnetic receiver. The magnetic receiver may comprise an electromagnet, a permanent magnet, or a magnetically receptive material, capable of forming a securing magnetic bond with the lock 114. The securing device 118 is configured to automatically lock the platform 34 in the closed position, as shown in FIG. 11, and the open position. In operation, the lock 120 may be set to be magnetically activated once the platform 34 reaches the closed position or open position. The lock 120 may be attracted to the support 122 upon the platform 34 moving to the closed position or open position, thus automatically securing the platform 34 in position. The securing device 118 may be unlocked by deactivating the magnetic field attracting the lock 120 and support 122. In other embodiments, the support 122 may comprise an electromagnet and the lock 120 may comprise a permanent magnet, or a magnetically receptive material.

Figure 13:
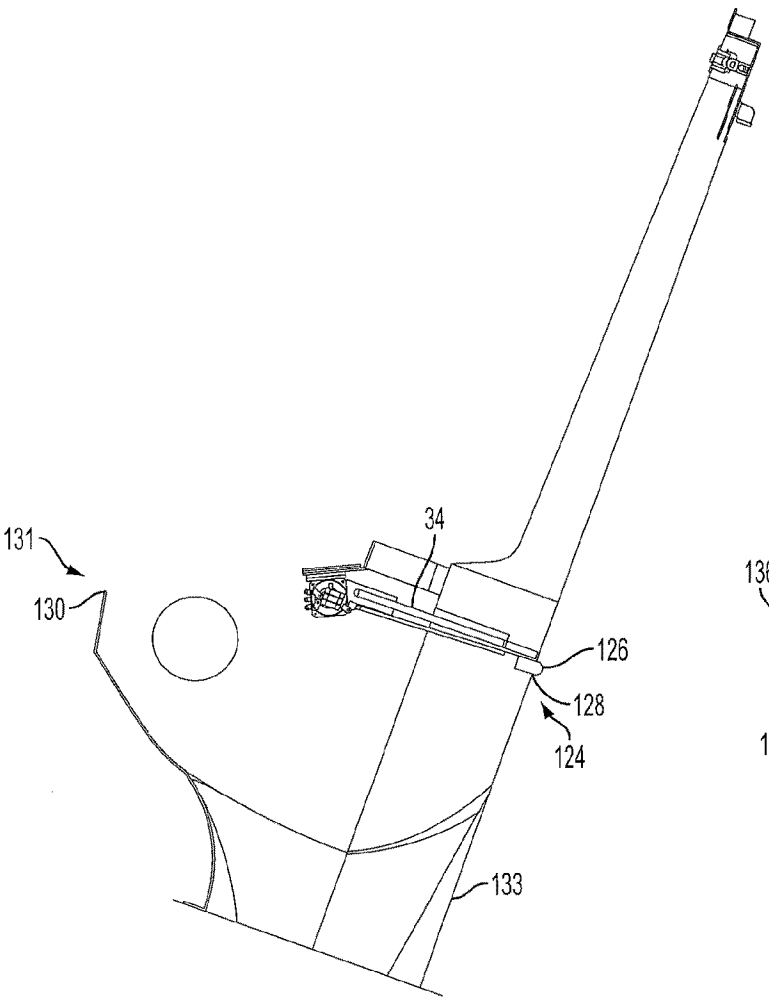
FIG. 13 shows a side cross sectional view of a trapdoor mechanism according to an embodiment of the present invention, taken along a line substantially at a middle of the trapdoor mechanism.

FIG. 13 illustrates an embodiment of a securing device 124 comprising a lock 126 in the form of a curved pin configured to enter into a support 128 in the form of an aperture, in the closed position. In the open position of FIG. 13, the securing device 131 includes a support 130 comprising an edge of the flume segment, or slide segment 133. The slide segment 133 in this embodiment does not include a lid 84, as shown in FIG. 8A, thus allowing the platform 34 to rotate to a position greater than the open position shown in FIG. 8F, for example. The platform 34 may therefore rotate to an angle that is at a greater angular distance from the closed position, than the angular distance of the open position shown in FIG. 8F, for example, from the closed position shown in FIG. 8A, for example. In the embodiment shown in FIG. 13, the support 128 is positioned within a surface of a slide segment 133. The securing device 126 is configured to automatically lock the platform 34 in the closed position, as shown in FIG. 13. In operation, once the platform 34 moves to the closed position, the curved shape of the lock 126 allows the lock to slide into the support 128, automatically securing the platform 34 in position. The lock 126 includes an uncurved portion with rests against the surface of the support 128, securing the lock 126 in place. The securing device 124 is unlocked in the same manner as the securing device 52 shown in FIG. 5. For example, an actuator retracts the lock 126, causing the uncurved portion of the lock 126 to disengage from the support 128 and allowing the platform 34 to fall. The securing mechanism 131 secures the platform 34 in the open position, by the lock 128 resting on the edge 130 of the flume segment, or slide segment 133. The securing device 131 is unlocked in the same manner as the securing device 52 shown in FIG. 5. For example, an actuator retracts the lock 128, causing the uncurved portion of the lock 128 to disengage from the support 130 and allowing the platform 34 to fall.

Figure 14:
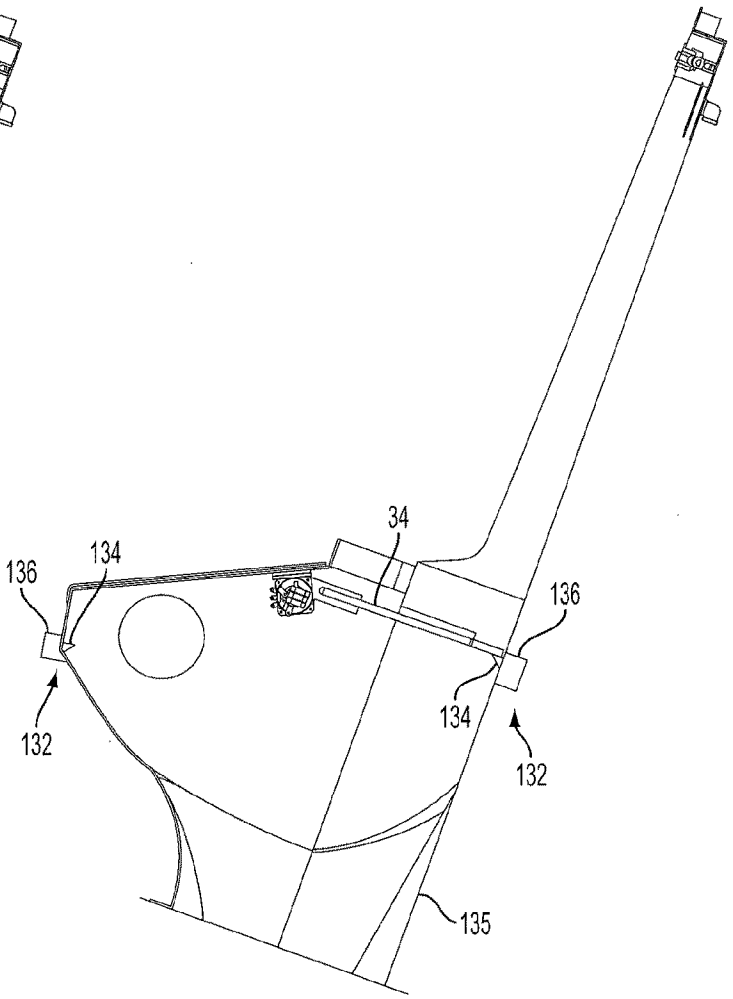
FIG. 14 shows a side cross sectional view of a trapdoor mechanism according to an embodiment of the present invention, taken along a line substantially at a middle of the trapdoor mechanism.

FIG. 14 illustrates an embodiment of a securing device 132 comprising a lock 134 in the form of moveable ledge that may retract to allow the platform 34 to fall. In this embodiment, the surface of the platform 34 itself serves as a support to engage the lock 134. An actuator 136 controls operation of the lock 134. The actuator 136 may be controlled by the control device 54, shown in FIG. 5, for example. The actuator 136 is coupled to a portion of the flume segment, or slide segment 135. The securing device 132 is configured to automatically lock the platform 34 in the closed position, as shown in FIG. 11, and the open position. In operation, once the platform 34 moves to the closed position or the open position, the tapered shape of the ledge of the lock 134 allows the lock 134 to slide over the edge of the platform 34, such that the platform 34 rests over the lock 134, automatically securing the platform 34 in position. The lock 134 includes an untapered portion with rests against the surface of the platform 34, securing the platform 34 in place. The securing device 132 is unlocked by the actuator 136 causing the lock 134 to retract, and allowing the platform 34 to fall. Any combination of locks and supports may be utilized to secure the platform 34 in a desired position. The securing devices may comprise any device capable of securing the platform 34 in position, and may be configured to automatically secure the platform 34 in position.

Figure 15:
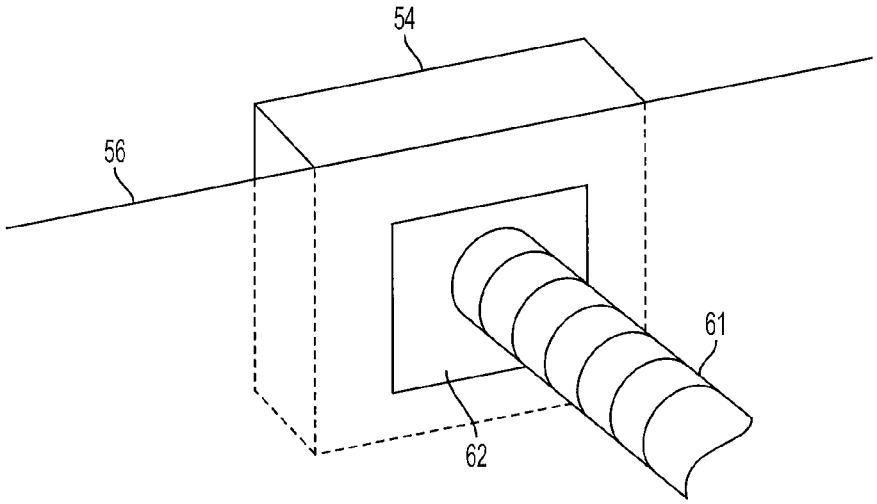
FIG. 15 is a perspective view of a feature of a trapdoor mechanism according to an embodiment of the present invention.

FIG. 15 illustrates a perspective view of the control device 54 in the embodiment shown in FIG. 5, for example. The pivot 61 comprises a rod-like structure that extends into the bearing 62 in the surface of the slide segment 56. The control device 54 may be positioned to receive the pivot 61. In other embodiments, the control device 54 may comprise a plurality of components positioned in various locations throughout the trapdoor mechanism. In the embodiment shown in FIG. 15, however, the control device 54 is represented as a singular unit capable of directly engaging with the pivot 61.

Figure 16:
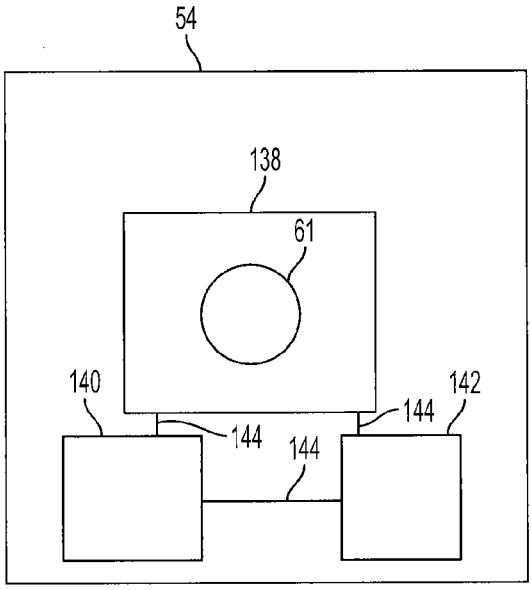
FIG. 16 is a schematic representation of a feature of a trapdoor mechanism according to an embodiment of the present invention.

FIG. 16 illustrates a schematic of the control device 54. The control device 54 may include a force generator 138, as discussed in regard to FIG. 5, a sensor 140, and a controller 142. Connectors 144 may link the force generator 138, sensor 140, and controller 142. The control device 54 may additionally include the actuator 66 shown in FIG. 5, and/or the actuators 136 shown in FIG. 14, and/or any other actuators disclosed in this application.

The force generator 138, as discussed in regard to FIG. 5, may comprise a motor, or a series of springs, or any other device capable of producing a force against the platform 34. The force generator 138 may be directly coupled to the pivot 61, thereby allowing the force generator 138 to drive the pivot 61 in any direction, with any force, as desired. As discussed in regard to FIG. 5, in operation, the force generator 138 may produce a force insufficient to convey the platform 34 (shown in FIG. 5) between the closed position and the open position. However, the force generated may be capable of overcoming frictional losses experienced by the platform 34. The force generator 138 may be configured to produce a varied amount of force, at varied sequences, as desired.

The sensor 140 may comprise a potentiometer, or any other device capable of detecting the position of the pivot 61 during operation. In one embodiment, the sensor 140 may be configured to detect when the platform 34 passes through the angle of the direction 78 of the force of gravity against the pivot 61, as shown in FIG. 8A, by the polarity of the potentiometer flipping between positive and negative voltages. In this embodiment, the sensor 140 may detect when the force generator 138 should apply a force to the platform 34. In other embodiments, the sensor 140 is capable of detecting any position of the platform 34, for example, but not limited to the closed position shown in FIG. 8A and the open position shown in FIG. 8F, for example. The sensor 140 in these embodiments may be able to detect when to actuate a securing mechanism to secure or release the platform 34.

The controller 142 may comprise a form of a processor and/or a memory capable of instructing the force generator 138, or any other related actuator, when and how to operate. The controller 142 may be programmable to include a sequence of timings and force strengths for the force generator 138 to apply, to effect various embodiments of the trapdoor mechanism discussed throughout this application. The controller 142 may control any of the securing mechanism actuators, instructing the actuators how and when to operate. In certain embodiments, the controller 142 may comprise a remote device operated by a slide ride operator.

In one embodiment, the force generator 138 remains coupled to the pivot 61 during operation. The sensor 140 in this embodiment may be configured to detect when the platform 34 does not have sufficient momentum caused by gravity to travel between the open position (shown in FIG. 8F, for example) and the closed position (shown in FIG. 8A, for example). In this state, the controller 142 may determine that the force generator 138 must apply a force to the platform 34, such that the platform 34 properly reaches the open position or closed position. However, when the force generator 138 does not apply a force, because the platform 34 is properly traveling between the open position (shown in FIG. 8F, for example) and the closed position (shown in FIG. 8A, for example), it is noted that platform 34 has sufficient moment of inertia to overdrive the coupled force generator 138 of the control device 54. Thus, the platform 34 is configured to overcome the force exerted by the coupled control device 54 during normal operation. In other embodiments, the control device 54 may be configured to decouple from the platform 34 at desired times to reduce the force exerted on the platform 34. In certain embodiments, the coupling of the force generator 138 to the pivot 61 may be sufficient to allow the force generator 138 to apply a force to the pivot 61, but the coupling may be configured to be insufficiently strong to produce enough friction to effectively impede motion of the platform 34, if the force generator 138 remains coupled to the pivot 61.

Figure 17:
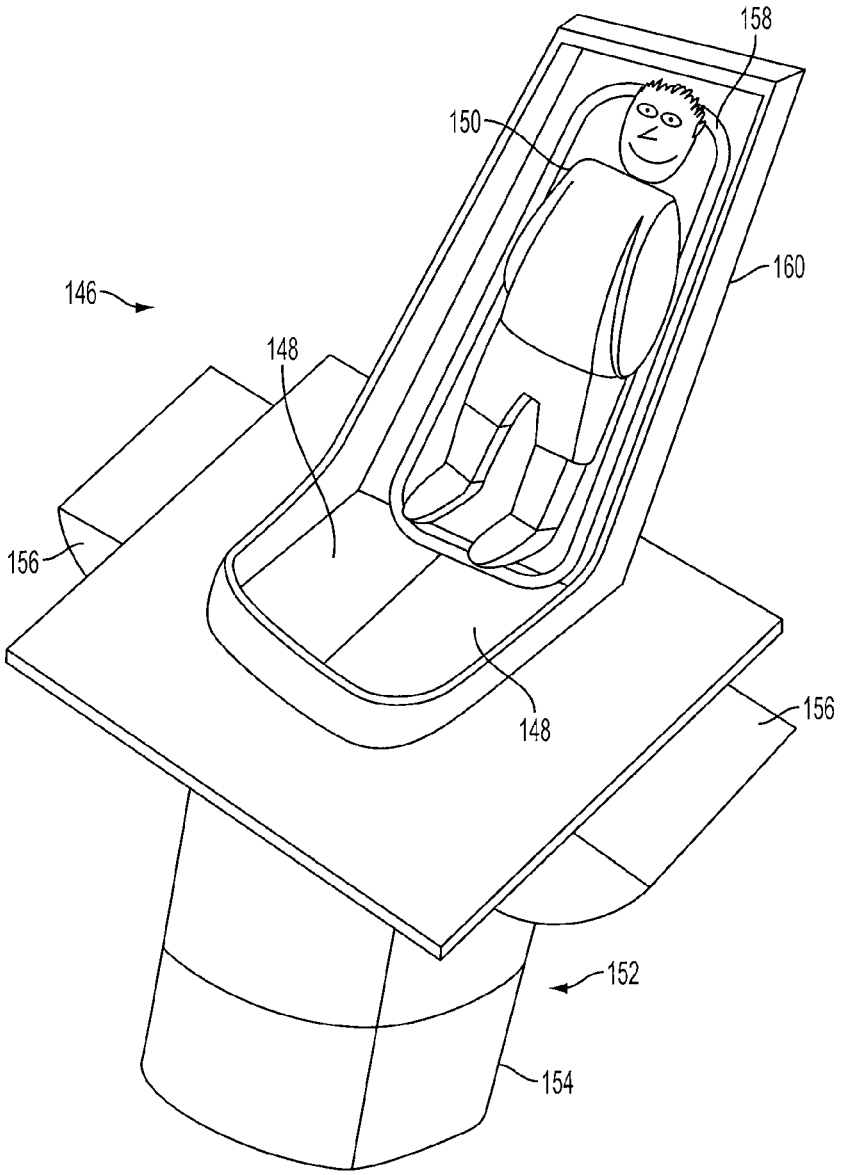
FIG. 17 is a perspective view of a trapdoor mechanism according to an embodiment of the present invention.

FIG. 17 illustrates an embodiment of a trapdoor mechanism 146 including two trapdoors, or gates, or platforms 148, which a rider 150 is positioned upon prior to descending into the entrance 152 of a flume segment, or slide segment 154. The trapdoor mechanism 146 may be otherwise configured identically as two of the trapdoor mechanisms 32 (shown in FIG. 3, for example) placed end to end, with each platform 148 rotating into respective recesses 156 (the support rest 40 and retainer 44 of FIG. 4 are not duplicated in FIG. 17). In other embodiments, any number of platforms 148 may be utilized as desired.

FIG. 17 additionally discloses the rider 150 being positioned on the platform 148 on a raft 158. The platforms 148 may be suitable secured to support the weight of the rider 150 and the raft 158. The support rest 160 may be configured as desired to properly allow the rider 150 and the raft 158 to drop into the entrance 152 of the slide segment 154. The raft 158 may slide along the surface of the slide ride, or may travel upon rollers, as desired. The raft 158 may comprise an inflatable raft, or rigid raft, or any other form of vehicle a rider 150 may use to travel on the slide ride.

Figure 18:
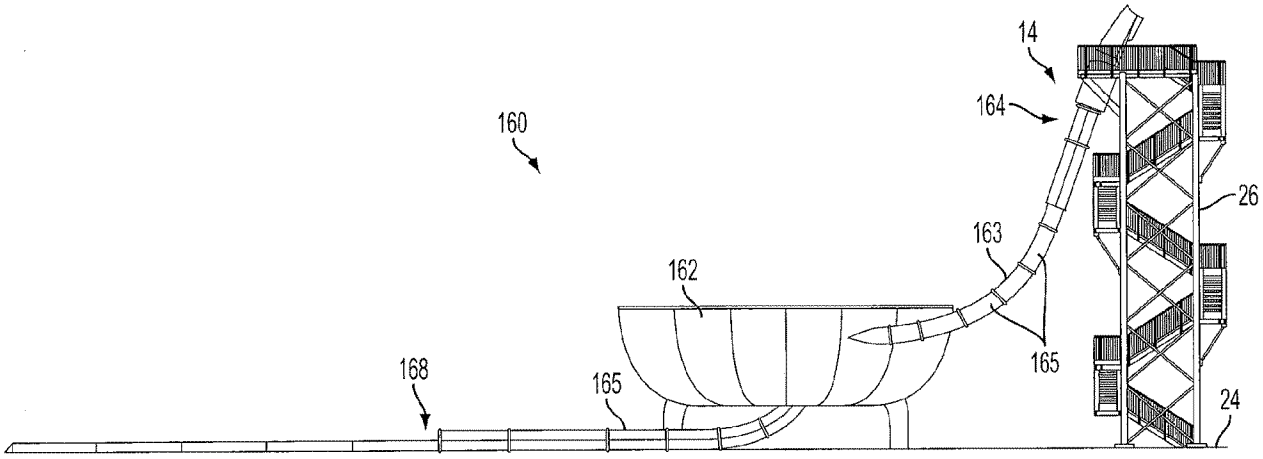
FIG. 18 is a side view of a waterslide ride according to an embodiment of the present invention.
Figure 19:
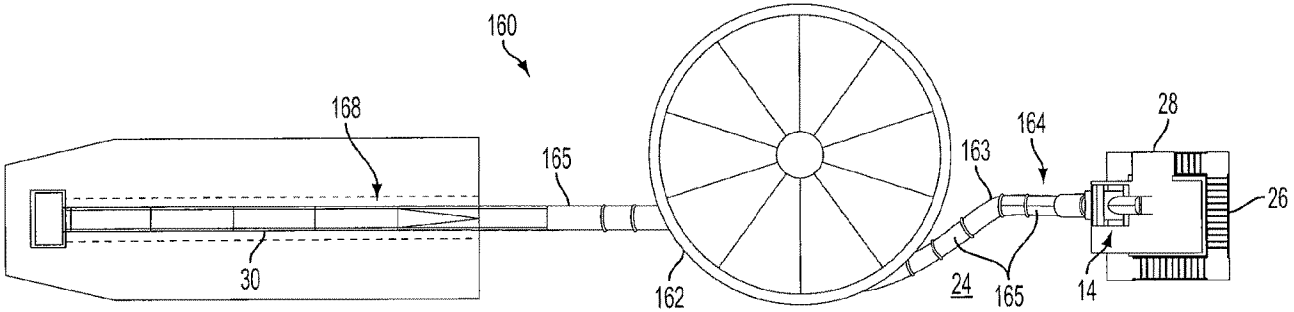
FIG. 19 is a top view of the waterslide ride of FIG. 18 according to an embodiment of the present invention.

FIGS. 18 and 19 illustrate an embodiment of the present invention including a slide ride in the form of a waterslide ride 160, configured as a flume 163 including a waterslide bowl 162. The waterslide ride 160 may include a trapdoor mechanism 14, that operates similarly as the trapdoor mechanism described in regard to FIGS. 1 and 2, and the mechanism 32 described in regard to FIGS. 3-7, for example, or any other trapdoor mechanism discussed or shown in this application. In this embodiment, the flume segments, or waterslide segments 165 stem from the entrance 164 of the waterslide ride 160 and lead to a bowl 162 the rider slides around before traveling to the exit 168 of the ride 160. Waterslide segments 165 additionally lead from the bowl 162 to the exit 168.

The benefits of various embodiments of the trapdoor mechanisms discussed throughout this application include a low energy method of releasing a rider through a trapdoor. Various embodiments of the trapdoor mechanisms discussed throughout this application utilize gravitational potential energy to produce kinetic energy, which conveys a trapdoor, gate, or platform between an open position and a closed position. Safety may also be enhanced, as various strong springs, pistons, and geared motors are not solely driving the trapdoor back to a starting position. Various embodiments of the trapdoor mechanism discussed throughout this application may also reduce cost to a rider operator, as the amount of power required to operate the rider is reduced. Other benefits include a reduction of mechanical complexity, an increase of rider throughput, and increased operational reliability.

Methods of providing a trapdoor mechanism, may include a method of allowing descent into a slide ride, or a slide ride in the form of a waterslide ride. Such methods may include providing any component of the trapdoor mechanism embodiments discussed throughout this application, or operating any component of the trapdoor mechanism embodiments discussed throughout this application.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An apparatus for initiating descent into a slide ride, comprising:

a slide segment for receiving a rider;

a platform movable between a first position and a second position, the platform in the first position being configured such that the rider is capable of being positioned upon the platform, the platform in the second position being configured such that the rider descends into the slide segment after having been positioned upon the platform when the platform is in the first position; and a control device configured to apply a force to the platform to move the platform from the second position to the first position, wherein the force and gravity are the only forces necessary to move the platform from the second position to the first position.

2. The apparatus of claim 1, wherein the platform is configured to pivot about an axis of rotation to move between the first position and the second position.

3. The apparatus of claim 2, wherein the platform is at a first angle relative to a direction of the force of gravity at the axis of rotation when the platform is at the first position, the platform is at a second angle relative to the direction of the force of gravity at the axis of rotation when the platform is at the second position, and the platform at the second angle is drawn to the direction of the force of gravity at the axis of rotation by the force of gravity exerted against the platform.

4. The apparatus of claim 3, wherein the platform is configured to be held in the first position by a securing device, and the first angle has a value equal to the second angle.

5. The apparatus of claim 1, wherein the platform is configured such that a period of oscillation for the platform to continuously swing from the first position to the second position and back to the first position is at least approximately four-thirds a time required for the rider to at least descend approximately seven feet and a length of the platform through the slide segment.

6. The apparatus of claim 1, wherein the platform has a moment of inertia sufficient to overdrive the control device.

7. The apparatus of claim 1, wherein the force applied by the control device to the platform is sufficient to overcome frictional forces exerted against the platform when the platform moves from the second position to the first position.

8. The apparatus of claim 1, further comprising a securing device for holding the platform in the second position.

9. The apparatus of claim 1, wherein the slide segment is a waterslide segment, and the platform is positioned at an entrance of the waterslide segment, the waterslide segment being configured such that a rider is capable of sliding on the waterslide segment on water.

10. The apparatus of claim 1, further comprising a securing device for securing the platform in the first position.

11. The apparatus of claim 1, wherein the platform moves to the first position from the second position at least during part of its movement solely by the force of gravity exerted against the platform.

12. The apparatus of claim 1 wherein the force aids gravity in moving the platform from the second position to the first position and the force is insufficient to move the platform from the second position to the first position without gravity.

13. An apparatus for initiating descent into a slide ride, comprising:

a slide segment for receiving a rider;

a platform movable between a first position and a second position, the platform in the first position being configured such that the rider is capable of being positioned upon the platform, the platform in the second position being configured such that the rider descends into the slide segment after having been positioned upon the platform when the platform is in the first position; and a control device configured to apply a force to move the platform from the second position to the first position, wherein the force is insufficient to overcome gravity such that both the force and gravity are required to move the platform from the second position to the first position.

* * * * *